US009058714B2

(12) United States Patent
Hamlin et al.

(10) Patent No.: US 9,058,714 B2
(45) Date of Patent: Jun. 16, 2015

(54) WAGERING GAME SYSTEMS, WAGERING GAMING MACHINES, AND WAGERING GAMING CHAIRS HAVING HAPTIC AND THERMAL FEEDBACK

(75) Inventors: Vernon W. Hamlin, Lisle, IL (US); Dion K. Aoki, Chicago, IL (US); Charles R. Bleich, Cary, IL (US); Mary M. Burke, Somonauk, IL (US); Joel R. Jaffe, Glenview, IL (US); Timothy C. Loose, Chicago, IL (US); Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 144 days.

(21) Appl. No.: 13/477,704

(22) Filed: May 22, 2012

(65) Prior Publication Data

US 2012/0302302 A1 Nov. 29, 2012

Related U.S. Application Data

(60) Provisional application No. 61/601,648, filed on Feb. 22, 2012, provisional application No. 61/488,981, filed on May 23, 2011.

(51) Int. Cl.
*A63F 9/24* (2006.01)
*G07F 17/32* (2006.01)

(52) U.S. Cl.
CPC ..... *G07F 17/3202* (2013.01)

(58) Field of Classification Search
USPC ..... 463/20
See application file for complete search history.

(56) References Cited

U.S. PATENT DOCUMENTS

| | | | |
|---|---|---|---|
| 4,624,459 | A | 11/1986 | Kaufman |
| 4,837,728 | A | 6/1989 | Barrie et al. |
| 4,948,134 | A | 8/1990 | Suttle et al. |
| 5,116,055 | A | 5/1992 | Tracy |
| 5,249,800 | A | 10/1993 | Hilgendorf et al. |
| 5,275,400 | A | 1/1994 | Weingardt et al. |
| 5,280,909 | A | 1/1994 | Tracy |
| 5,344,144 | A | 9/1994 | Canon |
| 5,377,973 | A | 1/1995 | Jones et al. |
| 5,393,057 | A | 2/1995 | Marnell, II |

(Continued)

FOREIGN PATENT DOCUMENTS

| | | |
|---|---|---|
| DE | 19624321 | 3/2002 |
| DE | 19515983 | 4/2003 |

(Continued)

OTHER PUBLICATIONS

"Big Games Safari", IGT, 24 pages (2000).

(Continued)

*Primary Examiner* — David L Lewis
*Assistant Examiner* — Shauna-Kay Hall
(74) *Attorney, Agent, or Firm* — Nixon Peabody LLP

(57) ABSTRACT

A gaming system for conducting a wagering game includes at least one input device configured to receive a wager, at least one display device configured to display a wagering game, one or more thermal devices configured to produce a thermal effect, at least one controller in operative communication with the one or more thermal devices, at least one memory device storing instructions. When the instructions are executed by the at least one controller, the one or more thermal devices to produce a thermal effect according to an aspect of the wagering game.

26 Claims, 13 Drawing Sheets

(56) References Cited

U.S. PATENT DOCUMENTS 5,524,888 A 6/1996 Heidel
5,544,892 A 8/1996 Breeding
5,564,700 A 10/1996 Celona
5,580,063 A 12/1996 Edwards
5,580,309 A 12/1996 Piechowiak et al.
5,611,730 A 3/1997 Weiss
5,645,486 A 7/1997 Nagao et al.
5,651,548 A 7/1997 French et al.
5,655,961 A 8/1997 Acres et al.
5,669,818 A * 9/1997 Thorner et al. ..... 463/30
5,735,742 A 4/1998 French
5,766,076 A 6/1998 Pease et al.
RE35,864 E 7/1998 Weingardt
5,779,549 A 7/1998 Walker et al.
5,816,918 A 10/1998 Kelly et al.
5,823,874 A 10/1998 Adams
5,830,063 A 11/1998 Byrne et al.
5,848,932 A 12/1998 Adams
5,855,515 A 1/1999 Pease et al.
5,876,284 A 3/1999 Acres et al.
5,885,158 A 3/1999 Torango et al.
5,889,670 A 3/1999 Schuler et al.
5,941,773 A 8/1999 Harlick
5,975,528 A 11/1999 Halaby
6,007,427 A 12/1999 Wiener et al.
6,012,982 A 1/2000 Piechowiak et al.
6,020,875 A 2/2000 Moore et al.
6,020,876 A 2/2000 Rosenberg et al.
6,024,576 A 2/2000 Bevirt et al.
6,039,648 A 3/2000 Guinn et al.
6,047,963 A 4/2000 Pierce et al.
6,077,162 A 6/2000 Weiss
6,089,977 A 7/2000 Bennett
6,089,980 A 7/2000 Gauselmann et al.
6,102,474 A 8/2000 Daley
6,102,798 A 8/2000 Bennett et al.
6,102,799 A 8/2000 Stupak
6,104,158 A 8/2000 Jacobus et al.
6,110,041 A 8/2000 Walker et al.
6,110,043 A 8/2000 Olsen
6,139,013 A 10/2000 Pierce et al.
6,139,324 A 10/2000 Roy et al.
6,142,872 A 11/2000 Walker et al.
6,146,273 A 11/2000 Olsen
6,155,925 A 12/2000 Giobbi et al.
6,158,741 A 12/2000 Koelling
6,159,097 A 12/2000 Gura
6,168,523 B1 1/2001 Piechowiak et al.
6,203,010 B1 3/2001 Jorasch et al.
6,206,374 B1 3/2001 Jones
6,206,782 B1 3/2001 Walker et al.
6,210,275 B1 4/2001 Olsen
6,210,277 B1 4/2001 Stefan
6,217,448 B1 4/2001 Olsen
6,220,593 B1 4/2001 Pierce et al.
6,224,482 B1 5/2001 Bennett et al.
6,224,484 B1 5/2001 Okuda et al.
6,231,445 B1 5/2001 Acres
6,252,579 B1 6/2001 Rosenberg et al.
6,254,483 B1 7/2001 Acres
6,256,011 B1 7/2001 Culver
6,280,328 B1 8/2001 Holch et al.
6,281,651 B1 8/2001 Haanpaa et al.
6,293,866 B1 9/2001 Walker et al.
6,300,938 B1 10/2001 Culver
6,304,091 B1 10/2001 Shahoian et al.
6,312,332 B1 11/2001 Walker et al.
6,315,660 B1 11/2001 DeMar et al.
6,319,125 B1 11/2001 Acres
6,319,127 B1 11/2001 Walker et al.
RE37,528 E 1/2002 Hannaford et al.
6,336,859 B2 1/2002 Jones et al.
6,336,862 B1 1/2002 Byrne et al.
6,345,824 B1 2/2002 Selitzky
6,358,149 B1 3/2002 Schneider et al.
6,361,441 B1 3/2002 Walker et al.
6,364,768 B1 4/2002 Acres et al.
6,375,567 B1 4/2002 Acres
6,375,568 B1 4/2002 Roffman et al.
6,416,408 B2 7/2002 Tracy et al.
6,416,409 B1 7/2002 Jordan
6,422,940 B1 7/2002 Walker et al.
6,424,333 B1 7/2002 Tremblay et al.
6,429,846 B2 8/2002 Rosenberg et al.
6,431,983 B2 8/2002 Acres
6,435,968 B1 8/2002 Torango
6,439,995 B1 8/2002 Hughs-Baird et al.
6,482,089 B2 11/2002 DeMar et al.
6,506,114 B1 1/2003 Estes
6,506,117 B2 1/2003 DeMar et al.
6,508,707 B2 1/2003 DeMar et al.
6,517,433 B2 2/2003 Loose et al.
6,520,855 B2 2/2003 DeMar et al.
6,545,661 B1 4/2003 Goschy et al.
6,564,168 B1 5/2003 Hasser
6,585,515 B1 7/2003 Roy et al.
6,589,115 B2 7/2003 Walker et al.
6,592,460 B2 7/2003 Torango
6,599,186 B1 7/2003 Walker et al.
6,599,188 B2 7/2003 Hirsch et al.
6,599,193 B2 7/2003 Baerlocher et al.
6,609,973 B1 8/2003 Weiss
6,623,357 B2 9/2003 Chowdhury
6,648,753 B1 11/2003 Tracy et al.
6,648,762 B2 11/2003 Walker et al.
6,650,952 B1 11/2003 Garcia et al.
6,656,041 B1 12/2003 Kaminkow
6,659,773 B2 12/2003 Roy et al.
6,662,560 B2 12/2003 Roy et al.
6,680,729 B1 1/2004 Shahoian et al.
6,683,437 B2 1/2004 Tierling
6,692,354 B2 2/2004 Tracy et al.
6,693,622 B1 2/2004 Shahoian et al.
6,703,550 B2 3/2004 Chu
6,704,683 B1 3/2004 Hasser
6,712,695 B2 3/2004 Mothwurf et al.
6,712,699 B2 3/2004 Walker et al.
6,733,390 B2 5/2004 Walker et al.
6,762,745 B1 7/2004 Braun et al.
6,781,569 B1 8/2004 Gregorio et al.
6,790,141 B2 9/2004 Muir et al.
6,802,778 B1 10/2004 Lemay et al.
6,833,846 B2 12/2004 Hasser
6,837,793 B2 1/2005 McClintic
6,864,877 B2 3/2005 Braun et al.
6,866,643 B2 3/2005 Kramer
6,887,157 B2 5/2005 LeMay et al.
6,887,159 B2 5/2005 Leen et al.
6,903,721 B2 6/2005 Braun et al.
6,904,823 B2 6/2005 Levin et al.
6,906,697 B2 6/2005 Rosenberg
6,924,787 B2 8/2005 Kramer et al.
6,932,706 B1 8/2005 Kaminkow
6,933,920 B2 8/2005 Lacroix et al.
6,937,033 B2 8/2005 Boronkay et al.
6,965,370 B2 11/2005 Gregorio et al.
6,979,164 B2 12/2005 Kramer
6,995,744 B1 2/2006 Moore et al.
7,024,625 B2 4/2006 Shalit
7,050,955 B1 5/2006 Carmel et al.
7,056,123 B2 6/2006 Gregorio et al.
7,057,613 B2 6/2006 Saikawa et al.
7,061,466 B1 6/2006 Moore et al.
7,070,571 B2 7/2006 Kramer et al.
7,096,852 B2 8/2006 Gregorio
7,112,737 B2 9/2006 Ramstein
7,116,317 B2 10/2006 Gregorio et al.
7,148,875 B2 12/2006 Rosenberg et al.
7,151,432 B2 12/2006 Tierling
7,154,470 B2 12/2006 Tierling
7,159,008 B1 1/2007 Wies et al.
7,161,580 B2 1/2007 Bailey et al.
7,166,029 B2 1/2007 Enzminger
7,182,691 B1 2/2007 Schena

(56) References Cited

U.S. PATENT DOCUMENTS 7,196,688 B2 3/2007 Schena
7,198,137 B2 4/2007 Olien
7,205,981 B2 4/2007 Cunningham
7,233,476 B2 6/2007 Goldenberg et al.
7,245,202 B2 7/2007 Levin
7,280,095 B2 10/2007 Grant
7,283,120 B2 10/2007 Grant
RE39,906 E 11/2007 Roston et al.
D559,328 S 1/2008 Rasmussen et al.
7,319,374 B2 1/2008 Shahoian
7,321,799 B2 1/2008 Pillard
7,331,868 B2 2/2008 Beaulieu et al.
7,336,260 B2 2/2008 Martin et al.
7,336,266 B2 2/2008 Hayward et al.
7,367,886 B2 5/2008 Loose et al.
7,369,115 B2 5/2008 Cruz-Hernandez et al.
7,465,230 B2 12/2008 LeMay et al.
7,479,063 B2 1/2009 Pryzby et al.
7,484,172 B2 1/2009 Walker et al.
7,518,862 B1 4/2009 Macika
7,572,186 B2 8/2009 LeMay et al.
7,722,453 B2 5/2010 Lark et al.
7,753,789 B2 7/2010 Walker et al.
7,766,747 B2 8/2010 Bonney et al.
7,803,053 B2 9/2010 Atkinson
7,883,413 B2 2/2011 Paulsen
7,918,738 B2 4/2011 Paulsen
8,029,369 B2 10/2011 Hahn
8,113,517 B2 2/2012 Canterbury et al.
8,210,942 B2 7/2012 Shimabukuro
8,303,419 B2 11/2012 Landsman
8,500,534 B2 8/2013 Rasmussen
2001/0005815 A1 6/2001 Rosenberg et al.
2001/0026266 A1 10/2001 Schena et al.
2002/0138594 A1 9/2002 Rowe
2002/0151345 A1 10/2002 Byrne
2002/0155874 A1 10/2002 Byrne
2003/0018403 A1 1/2003 Braun et al.
2003/0025723 A1 2/2003 Olien et al.
2003/0027618 A1 2/2003 Byrne
2003/0036430 A1 2/2003 Cannon
2003/0038776 A1 2/2003 Rosenberg et al.
2003/0045337 A1 3/2003 Byrne
2003/0045354 A1 3/2003 Giobbi
2003/0047874 A1 3/2003 Leen et al.
2003/0050106 A1 3/2003 Lyfoung
2003/0064776 A1 4/2003 Byrne
2003/0064807 A1 4/2003 Walker et al.
2003/0068053 A1 4/2003 Chu
2003/0073478 A1 4/2003 Kovacs
2003/0076298 A1 4/2003 Rosenberg
2003/0114218 A1 6/2003 McClintic
2003/0119576 A1 6/2003 McClintic et al.
2003/0148808 A1 8/2003 Price
2003/0181231 A1 9/2003 Vancura et al.
2003/0186733 A1 10/2003 Wolf et al.
2003/0216166 A1 11/2003 Baerlocher et al.
2003/0222402 A1 12/2003 Olive
2003/0224852 A1 12/2003 Walker
2003/0228899 A1 12/2003 Evans
2003/0236116 A1 12/2003 Marks et al.
2004/0009808 A1 1/2004 Gauselmann
2004/0009811 A1 1/2004 Torango
2004/0038741 A1 2/2004 Gauselmann
2004/0048644 A1 3/2004 Gerrard et al.
2004/0087368 A1 5/2004 Gauselmann
2004/0106448 A1 6/2004 Gauselmann
2004/0132524 A1 7/2004 Ramstad et al.
2004/0166930 A1 8/2004 Beaulieu et al.
2004/0166937 A1 8/2004 Rothschild et al.
2004/0204226 A1 10/2004 Foster et al.
2004/0204235 A1 10/2004 Walker et al.
2004/0229192 A1 11/2004 Roy et al.
2004/0235552 A1 11/2004 Gauselmann
2004/0235570 A1 11/2004 Rothschild et al. ..... 463/46
2004/0242297 A1 12/2004 Walker et al.
2004/0242303 A1 12/2004 Walker et al.
2005/0014554 A1 1/2005 Walker et al.
2005/0026674 A1 2/2005 Wolf et al.
2005/0032568 A1 2/2005 Griswold et al.
2005/0140088 A1 6/2005 Randall
2005/0148382 A1 7/2005 Fox
2005/0187008 A1 8/2005 Nakajima
2005/0192073 A1 9/2005 Nakajima
2005/0192091 A1 9/2005 Siewert et al.
2005/0197181 A1 9/2005 Jaffe
2005/0248549 A1 11/2005 Dietz et al.
2005/0282603 A1 12/2005 Parrott et al.
2005/0282628 A1 12/2005 Beatty et al.
2006/0012118 A1 1/2006 Mamitsu et al.
2006/0014580 A1 1/2006 Hawthorn
2006/0022952 A1 2/2006 Ryynanen
2006/0033662 A1 2/2006 Ward et al.
2006/0040739 A1 2/2006 Wells
2006/0058100 A1 3/2006 Pacey et al.
2006/0066569 A1 3/2006 Eid et al.
2006/0109256 A1 5/2006 Grant et al.
2006/0119586 A1 6/2006 Grant et al.
2006/0119589 A1 6/2006 Rosenberg et al.
2006/0135248 A1 6/2006 Anderson et al.
2006/0157632 A1 7/2006 Delson
2006/0187215 A1 8/2006 Rosenberg et al.
2006/0192771 A1 8/2006 Rosenberg et al.
2006/0256075 A1 11/2006 Anastas et al.
2006/0256234 A1 11/2006 Roy et al.
2006/0256972 A1 11/2006 Roy et al.
2006/0281530 A1 12/2006 Seelig et al.
2006/0290662 A1 12/2006 Houston et al.
2007/0004510 A1 1/2007 Underdahl et al.
2007/0013677 A1 1/2007 Rosenberg et al.
2007/0021218 A1* 1/2007 Okada ..... 463/47
2007/0040815 A1 2/2007 Rosenberg et al.
2007/0057913 A1 3/2007 Eid et al.
2007/0066393 A1 3/2007 Paul et al.
2007/0122793 A1 5/2007 Orban et al.
2007/0149281 A1 6/2007 Gadda et al.
2007/0182711 A1 8/2007 Grant et al.
2007/0232348 A1 10/2007 Tierling et al.
2007/0236449 A1 10/2007 Lacroix et al.
2007/0236474 A1 10/2007 Ramstein
2007/0242040 A1 10/2007 Ullrich et al.
2007/0259717 A1 11/2007 Mattice et al.
2007/0270216 A1 11/2007 Pryzby
2007/0279401 A1 12/2007 Ramstein et al.
2008/0024440 A1 1/2008 Olien et al.
2008/0039215 A1 2/2008 Hahn
2008/0045331 A1 2/2008 LeMay et al.
2008/0054561 A1* 3/2008 Canterbury et al. ..... 273/148 B
2008/0055244 A1 3/2008 Cruz-Hernandez et al.
2008/0064499 A1 3/2008 Grant et al.
2008/0068334 A1 3/2008 Olien et al.
2008/0084384 A1 4/2008 Gregorio et al.
2008/0090656 A1* 4/2008 Hartwig ..... 463/30
2008/0100584 A1 5/2008 Hague et al.
2008/0109265 A1 5/2008 Roy et al.
2008/0132313 A1* 6/2008 Rasmussen et al. ..... 463/16
2008/0211276 A1 9/2008 Rasmussen
2008/0238937 A1* 10/2008 Muraki ..... 345/619
2008/0246321 A1 10/2008 Canterbury
2008/0316701 A1 12/2008 Cole ..... 361/690
2009/0062001 A1 3/2009 LeMay et al.
2009/0079690 A1 3/2009 Watson et al. ..... 345/156
2009/0137312 A1* 5/2009 Walker et al. ..... 463/25
2010/0029391 A1 2/2010 Greenberg
2010/0090507 A1 4/2010 Boulais et al.
2010/0099487 A1 4/2010 Canterbury et al. ..... 463/25
2010/0160016 A1* 6/2010 Shimabukuro et al. ..... 463/16
2010/0234094 A1 9/2010 Gagner et al.
2010/0261523 A1 10/2010 Bonney et al. ..... 463/25
2010/0291993 A1 11/2010 Gagner et al.
2011/0003631 A1 1/2011 Tastad
2011/0111839 A1 5/2011 Lesley et al.
2011/0111847 A1 5/2011 Lesley et al.

(56) References Cited

U.S. PATENT DOCUMENTS

| | | | |
|---|---|---|---|
| 2012/0108321 | A1 | 5/2012 | Radek et al. |
| 2012/0108333 | A1 | 5/2012 | Radek et al. |
| 2012/0115589 | A1 | 5/2012 | Canterbury et al. |

FOREIGN PATENT DOCUMENTS

| | | |
|---|---|---|
| EP | 0521599 | 1/1993 |
| GB | 2153572 | 8/1985 |
| GB | 2181589 | 4/1987 |
| GB | 2242300 | 9/1991 |
| GB | 2313792 | 12/1997 |
| GB | 2333880 | 8/1999 |
| WO | WO 99/03078 | 1/1999 |
| WO | WO 9919037 | 4/1999 |
| WO | WO 99/56087 | 11/1999 |
| WO | WO 0133478 | 5/2001 |
| WO | WO 02/078810 | 10/2002 |
| WO | WO 03/012557 | 2/2003 |
| WO | WO 03/026754 | 4/2003 |
| WO | WO 03/032289 | 4/2003 |
| WO | WO 03/051062 | 6/2003 |
| WO | WO 03/083789 | 10/2003 |
| WO | WO 2004/036405 | 4/2004 |
| WO | WO 2004/038573 | 5/2004 |
| WO | WO 2004/109488 | 12/2004 |
| WO | WO 2004/111818 | 12/2004 |
| WO | WO 2004/111819 | 12/2004 |
| WO | WO 2005/057546 | 6/2005 |
| WO | WO 2005/065113 | 7/2005 |
| WO | WO 2005/065147 | 7/2005 |
| WO | WO 2005/117648 | 12/2005 |
| WO | WO 2005/117649 | 12/2005 |
| WO | WO 2006/017254 | 2/2006 |
| WO | WO 2006/019389 | 2/2006 |
| WO | WO 2006/036458 | 4/2006 |
| WO | WO 2006/071449 | 7/2006 |
| WO | WO 2007/003928 | 1/2007 |
| WO | WO 2007/043036 | 4/2007 |
| WO | WO 2007/047960 | 4/2007 |
| WO | WO 2007/059172 | 5/2007 |
| WO | WO 2007/143849 | 12/2007 |
| WO | WO 2008/042745 | 4/2008 |
| WO | WO 2008/048831 | 4/2008 |
| WO | WO 2008/049217 | 5/2008 |
| WO | WO 2011/060331 | 5/2011 |

OTHER PUBLICATIONS

"Easy Riches" by Sigma Game, Strictly Slots, 1 page (Aug. 2001).

"Millioniser" by Glenn Haussman, Strictly Slots, pp. 50-53 (Mar. 2004).

"New '97 Games", International Gaming & Wagering Business, 24 pages (Mar. 1997).

Gesture Central—Use Your Head Specs and Tech, http://www.gesturecentral.com/useyourhead/specs.html, (downloaded 2007); (4 pages).

International Search Report corresponding to co-pending International Patent Application Serial No. PCT/US2008/005910, European Patent Office; dated Sep. 5, 2008; 2 pages.

International Search Report corresponding to co-pending International Patent Application Serial No. PCT/US2008/082990, United States Patent Office; dated Jan. 27, 2009; 3 pages.

International Search Report, PCT/US2006/034830, 3pages, dated Jul. 9, 2007.

Money: Eon Technology puts holograms at hand—OCRegister.com; http://www.ocregister.com/ocregister/money/abox/article_1287471.php; (downloaded 2007); (7 pages).

PrimeSense, http://primesense.com/markets.html, (downloaded 2007); (2 pages).

See, hear and feel the game with amBX; Philips amBX for SGC5103BD brochure; dated Jul. 17, 2007; (2 pages).

Written Opinion corresponding to co-pending International Patent Application Serial No. PCT/US2008/005910, European Patent Office; dated Sep. 5, 2008; 7 pages.

Written Opinion corresponding to co-pending International Patent Application Serial No. PCT/US2008/082990, United States Patent Office; dated Jan. 27, 2009; 9 pages.

* cited by examiner

WAGERING GAME SYSTEMS, WAGERING GAMING MACHINES, AND WAGERING GAMING CHAIRS HAVING HAPTIC AND THERMAL FEEDBACK

CROSS-REFERENCE AND CLAIM OF PRIORITY TO RELATED APPLICATIONS

This application claims the benefit of and priority to U.S. Provisional Patent Application No. 61/601,648, which was filed on Feb. 22, 2012, and U.S. Provisional Patent Application No. 61/488,981, which was filed on May 23, 2011, both of which are incorporated herein by reference in their respective entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present disclosure relates generally to wagering game machines and gaming systems. More particularly, the present disclosure relates to haptic gaming chairs, as well as wagering game machines and systems with one or more haptic gaming chairs.

BACKGROUND

Gaming machines, such as slot machines, video poker machines, and the like, have been a cornerstone of the gaming industry for several years. Generally, the popularity of such machines with players is dependent on the likelihood (or perceived likelihood) of winning money at the machine, as well as the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Consequently, shrewd operators strive to employ the most entertaining and exciting machines, features, and enhancements available because such machines attract frequent play, enhance player loyalty and, hence, increase profitability to the operator.

Heretofore, gaming machine design and innovation has focused primarily on attraction devices, lighting, payout mechanisms, networking, and predominantly on game play, such as base game characteristics and enhancements, bonus rounds, and progressive-type game play. Gaming chairs have received less attention, with such attention being generally limited to improving player comfort and convenience. Even less attention has been paid to automating chair positioning, integrating haptic or thermal technology, and improving other tactile features.

While player comfort has been addressed to some extent, typically, it has been isolated to chair ergonomics and the incorporation of adjustable features, such as pivotable arm rests, stowable cup holders, etc. For instance, players typically cannot sit back in the gaming chair and relax in comfort because the game play buttons are located on the gaming machine, which requires most players to lean forward. Materials used to promote comfort for individuals maintaining a prone, seated position for extended periods of time have been incorporated to alleviate discomfort and create an environment that enhances the gaming experience. Additionally, for example, some gaming chairs provide climate control features to heat or cool a player environment solely for player comfort purposes.

Convenience features also enhance the enjoyment realized by gaming patrons. For example, footrests, adjustable headrests, and adjustable-height seat cushions allow for players of different sizes and preferences to use and enjoy the same gaming chair. In addition, chair-mounted gaming buttons eliminate the need for players to reach for standard input devices on the cabinet, making the player's gaming experience more comfortable and convenient, and thus more enjoyable.

As the complexity and capacity of microcomputer programs continue to grow, the graphics and audio of wagering games have become more realistic and intense. As a result, different accessories have been provided to enhance the players audio and visual experiences. Surround-sound speaker systems and high-definition wide-screen displays are just some of the accessories that are available on modern gaming machines, including gaming chairs, to enhance the graphic and acoustic output of wagering games and, thus, increase player enjoyment.

Another recent enhancement for wagering game chairs is automation of the seat of the gaming chair. Historically, gaming chair seats were mechanized to provide adjustable heights and positioning to afford improved player comfort. More recently, however, gaming chair seats have been modified to vibrate or shift during game play to simulate events that occur in the wagering game. On a much more limited scale, some gaming chairs have been designed with specialized hardware, such as fans and heating elements, for climate control purposes. Additional improvements to gaming chair features can add to the value and excitement of the gaming environment.

Automated gaming chairs that are presently available in the wagering game industry have a number of identifiable drawbacks. As an initial matter, fully-automated gaming chairs with moving seats, backrests, footrests, etc., are very expensive to manufacture and maintain due to the requisite hardware. Another known drawback is that "full-motion" gaming chairs with moving seats and backrests can cause anxiety and discomfort for some players, especially the handicapped and the elderly. Moreover, full-motion chairs can also cause the player's head and body to move relative to the gaming terminal, which can interfere with other gaming features, such as 3D display and audio technology, "controller free" gesture-based gaming, and facial-recognition-based features. In instances where the chair is being misused, abrupt motion of the chair may be undesirable, uncomfortable, and/or potentially hazardous. Current chair designs are not provided with the requisite hardware to address these issues.

SUMMARY

According to aspects of the present disclosure, a gaming system for playing a wagering game is presented. The gaming system includes an input device for receiving a wager from a player to play the wagering game. A display device displays the outcome of the wagering game, which is randomly determined from a plurality of wagering game outcomes. The gaming system also includes a gaming chair with a seat portion, a backrest portion, and a base supporting the seat and backrest portions. An array of tactors is at least partially embedded within the seat portion, the backrest portion, or both. The array of tactors is configured to generate tactile stimulation. A controller is in operative communication with the array of tactors. The controller is configured to synchronize actuation of the array of tactors to coincide with aspects of the wagering game being displayed via the display device.

According to other aspects of the present disclosure, a gaming system is provided for playing a wagering game. This gaming system includes a display for displaying outcomes of the wagering game, each outcome being determined from a plurality of wagering game outcomes. The gaming system also includes a gaming chair and an array of tactors operatively connected to the gaming chair, each tactor being configured to generate a respective tactile stimulation. A controller is in operative communication with the array of tactors. The controller is configured to coordinate actuation of the array of tactors with displayed aspects of the wagering game being displayed via the display device to thereby elicit a predetermined reflex by the player.

According to additional aspects of the present disclosure, a gaming system for playing a wagering game is disclosed. This gaming system includes a display for displaying outcomes of the wagering game, each outcome being determined from a plurality of wagering game outcomes. The gaming system also includes a gaming chair and an array of tactors operatively connected to the gaming chair, each tactor being configured to generate a respective tactile stimulation. A controller is in operative communication with the array of tactors. The controller is configured to coordinate actuation of the array of tactors with displayed aspects of the wagering game to thereby output a sensation of contact with objects being displayed via the display device.

According to additional aspects of the present disclosure, a haptic gaming chair for a wagering game system is presented. The wagering game system has a display device that is operable to display events associated with a wagering game. The haptic gaming chair includes a seat portion, a backrest portion, and a base connected to and supporting the seat and backrest portions. An array of tactors is at least partially embedded within the seat portion, the backrest portion, or both. Each tactor is designed to generate a respective tactile stimulation. A controller, which is in operative communication with the tactors, is configured to synchronize actuation of the array of tactors to coincide with the displayed events of the wagering game.

According to more aspects of the present disclosure, a method is presented for conducting a wagering game on a gaming system with a haptic gaming chair, a controller, and a display device. The method includes: receiving an indication of a wager from a player to play the wagering game; displaying, via the display device, an event associated with the wagering game; and activating, via the controller, one or more discrete tactors embedded within the haptic gaming chair to output, via the one or more discrete tactors, a tactile simulation of an aspect related to the event displayed via the display device.

According to additional aspects of the present disclosure, a gaming system for conducting a wagering game includes at least one input device configured to receive a wager, at least one display device configured to display a wagering game, one or more thermal devices configured to produce a thermal effect, at least one controller in operative communication with the one or more thermal devices, at least one memory device storing instructions. When the instructions are executed by the at least one controller, the one or more thermal devices to produce a thermal effect according to an aspect of the wagering game.

According to more aspects of the present disclosure, a gaming chair for a wagering game system configured to conduct a wagering game includes a seat portion, a backrest portion, and a base connected to and supporting the seat portion and the backrest portion. The gaming chair further includes at least one thermal device configured to produce a thermal effect. The gaming chair also includes at least one controller in operative communication with the at least one thermal device. The at least one controller is configured to actuate the at least one thermal device according to an aspect of the wagering game.

According to more aspects of the present disclosure, a method of conducting a wagering game on a wagering game system includes receiving a wager to initiate a wagering game, displaying, via the at least one display device, the wagering game, and actuating the at least one thermal device according to an aspect of the wagering game.

The above summary is not intended to represent each embodiment, or every aspect, of the present disclosure. The above features and advantages, and other features and advantages of the present disclosure, will be readily apparent from the following detailed description of the preferred embodiments and best modes for carrying out the invention when taken in connection with the accompanying drawings and appended claims.

BRIEF DESCRIPTION OF THE DRAWINGS

FIGS. 5A-5D are enlarged schematic illustrations of the various tactor matrices embedded within the exemplary haptic gaming chair of FIG. 5.

FIGS. 15A-15D are enlarged schematic illustrations of the various thermal device matrices disposed within the exemplary thermal-effect gaming chair of FIG. 5.

Figure 1:
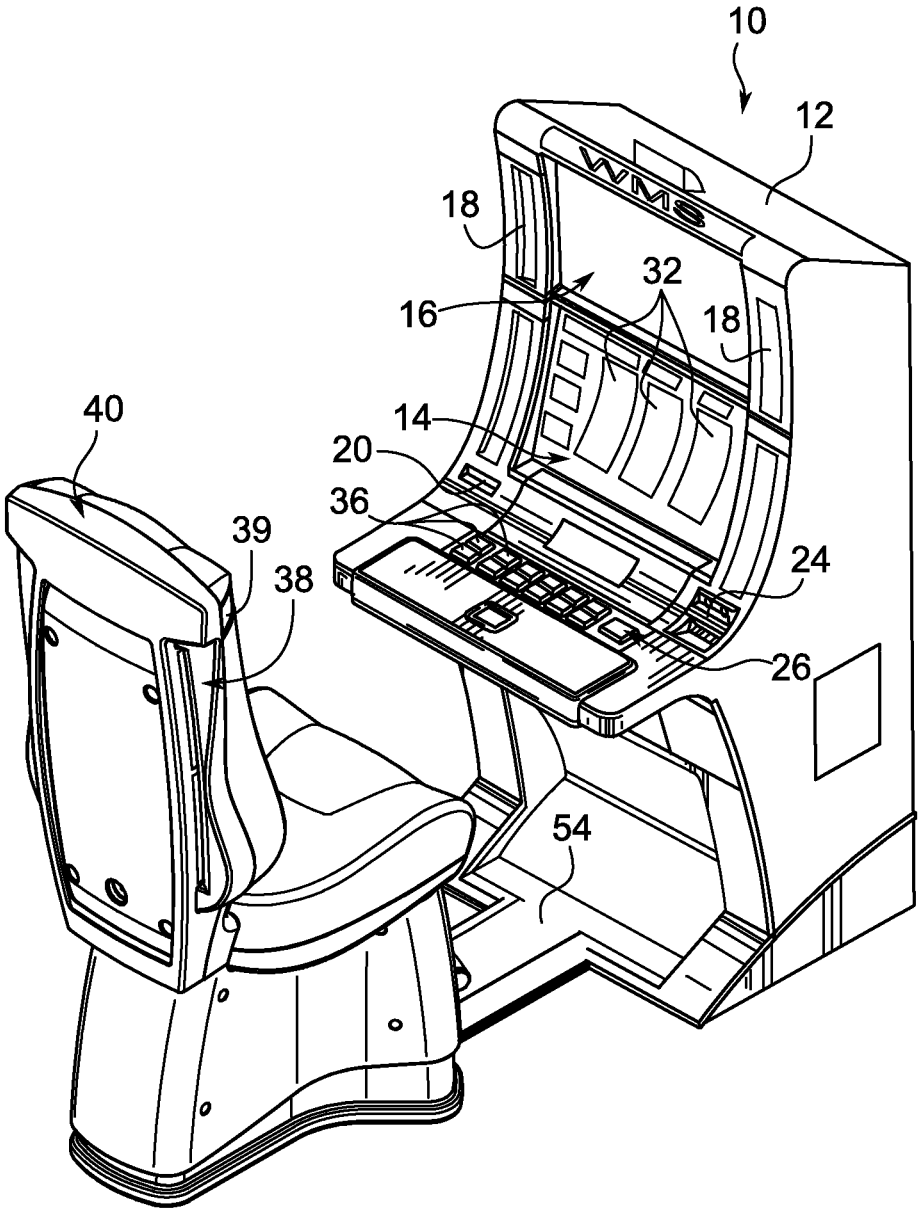
FIG. 1 is a perspective-view illustration of an exemplary gaming terminal with a haptic gaming chair in accordance with aspects of the present disclosure.

While the invention is susceptible to various modifications and alternative forms, specific embodiments have been shown by way of example in the drawings and will be described in detail herein. It should be understood, however, that this disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE EXEMPLARY EMBODIMENTS

While this invention is susceptible of embodiment in many different forms, there are shown in the drawings and will herein be described in detail representative embodiments of the disclosure with the understanding that the present disclosure is to be considered as an exemplification of the principles of the invention and is not intended to limit the broad aspect of the invention to the embodiments illustrated. To that extent, elements and limitations that are disclosed herein, for example, in the Abstract, Summary, and Detailed Description of the Embodiments sections, but not explicitly set forth in the claims, should not be incorporated into the claims, singly or collectively, by implication, inference or otherwise.

Referring to FIG. 1, a perspective-view illustration of an exemplary gaming terminal 10 (also referred to herein as "wagering game machine" or "gaming machine") is shown in accordance with one embodiment of the present disclosure. The gaming terminal 10 of FIG. 1 may be used, for example, in traditional gaming establishments, such as casinos, and non-traditional gaming establishments, such as pools, hotels, restaurants, and airports. With regard to the present disclosure, the gaming terminal 10 may be any type of gaming terminal and may have varying structures and methods of operation. For instance, the gaming terminal 10 may be an electromechanical gaming terminal configured, for example, to play mechanical slots, or it may be an electronic gaming terminal configured, for example, to play a video casino game, such as slots, keno, poker, blackjack, roulette, craps, etc. It should be understood that although the gaming terminal 10 is shown as a free-standing gaming terminal of the upright type, the gaming machines of the present disclosure may take on a wide variety of other forms, such as free-standing gaming terminals of the slant-top type, "countertop" gaming devices, hand-held or portable gaming devices, etc. Finally, the drawings presented herein are not to scale and are provided purely for instructional purposes; as such, the individual and relative dimensions shown in the drawings are not to be considered limiting.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor (not shown), one or more information readers 24, one or more player-input devices 26, and one or more player-accessible ports 28 (e.g., an audio output jack for headphones, a video headset jack, a wireless transmitter/receiver, etc., shown in FIG. 2). While these typical components found in the gaming terminal 10 are described below, it should be understood that numerous additional/alternative peripheral devices and other elements may exist and can be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in commonly owned U.S. Pat. No. 6,517,433, to Loose et al., entitled "Reel Spinning Slot Machine with Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10.

Figure 3:
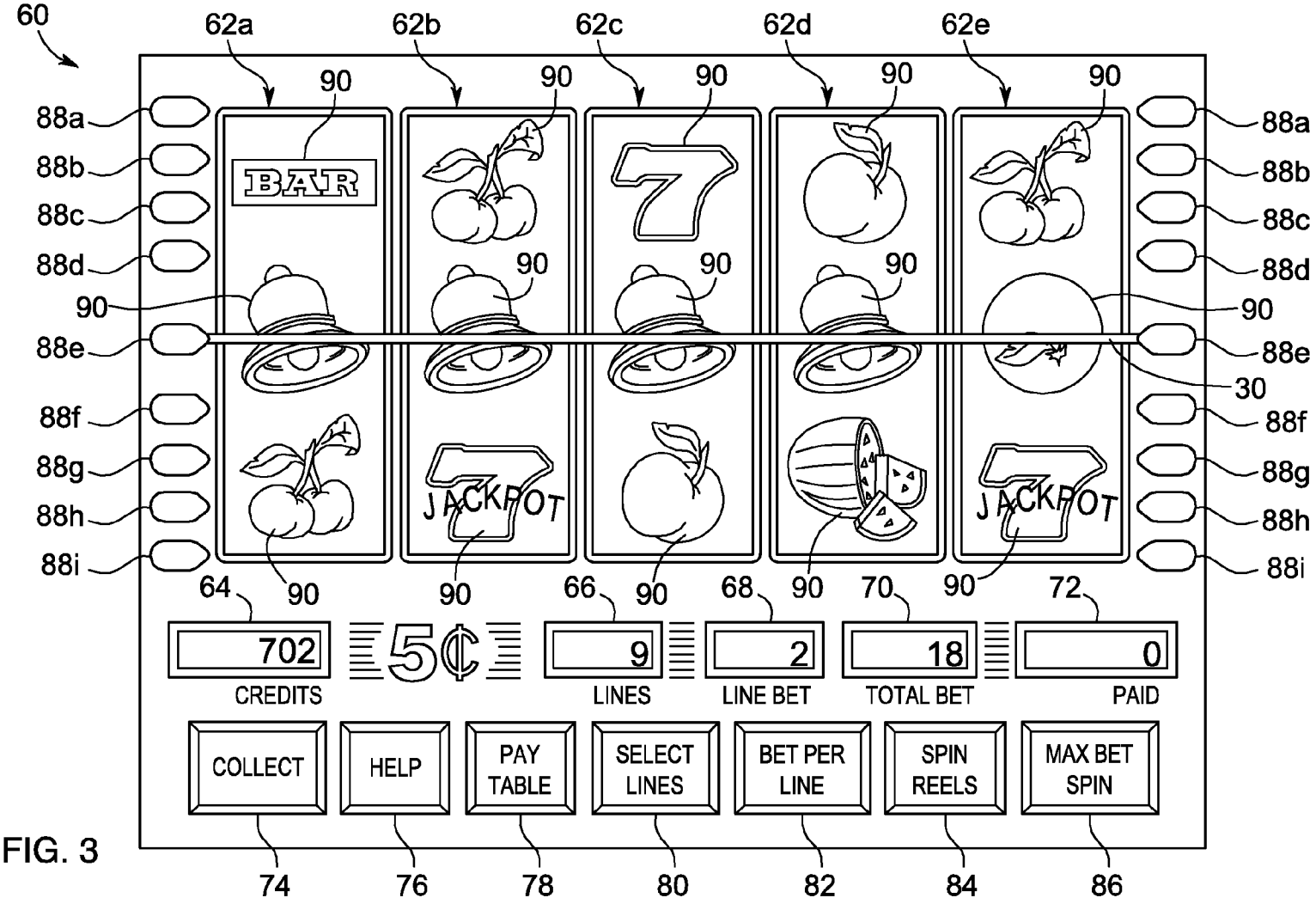
FIG. 3 is a screen shot of a basic-game screen of an exemplary wagering game that can be played on the gaming terminal of FIG. 1 and/or the gaming system of FIG. 2.

As seen, for example, in FIG. 3, the primary display area 14 may include one or more paylines 30 extending along a portion thereof. In some embodiments, the primary display area 14 comprises a plurality of mechanical reels (e.g., the mechanical reels 32 shown in FIG. 1) and a video display 34 such as a transmissive display (or a reflected image arrangement in other embodiments) in front of the mechanical reels 32. If the wagering game conducted via the gaming terminal 10 relies upon the video display 34 only, and not the mechanical reels 32, the mechanical reels 32 may be removed from the interior of the terminal 10 and the video display 34 may be of a non-transmissive type (featured below in a representative embodiment in FIG. 3). In contrast, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include, for example, a plurality of buttons 36 on a button panel. In addition, or as an alternative thereto, a touch screen may be mounted over the primary display area 14 and/or the secondary display area 16 and having one or more soft touch keys, as exemplified in FIG. 3. The player-input devices 26 may further comprise technologies that do not rely upon touching the gaming terminal, such as speech-recognition technology, movement- and gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed, for example, in U.S. Patent Application Publication No. 2003/0045354, entitled "Portable Data Unit for Communicating with Gaming Machine Over Wireless Link," which is incorporated herein by reference in its entirety. The account may be stored directly on the portable medium, or at an external system 46 (see FIG. 2) as more fully disclosed, for example, in U.S. Pat. No. 6,280,328, to Holch et al., entitled "Cashless Computerized Video Game System and Method," which is incorporated herein by referenced in its entirety. To enhance security, the individual carrying the portable medium may be required to enter a secondary independent authenticator (e.g., password, PIN number, biometric, etc.) to access their account.

FIG. 1 depicts the gaming terminal 10 with an attached gaming chair 40. This representative gaming chair 40 is located in operational proximity of the gaming terminal 10. For instance, in the illustrated embodiment of FIG. 1, the gaming chair 40 is mounted to the gaming floor, facing the gaming terminal 10—i.e., immediately adjacent and in opposing relation to the gaming terminal 10. The gaming chair 40 is operable to receive and process signals from the gaming terminal 10. In this exemplary embodiment, the gaming chair 40 is electrically and mechanically coupled to the gaming terminal 10 via a sled 54. Alternatively, the gaming chair 40 can be detachably coupled to the gaming floor and/or the gaming terminal 10, or the gaming chair 40 can lack any physical connection with the gaming floor and/or the gaming terminal 10. As additional design options, the gaming chair 40 can be operatively coupled to the gaming terminal 10 via alternative means, such as a wireless interface (e.g., infrared, radio, laser, or other wireless communication technologies) or other hard line connections (e.g., fiber optic cabling). Also, as described below, the gaming chair 40 may include a variety of haptic components and haptic gaming-related features, and/or a variety of thermal components and thermal gaming-related features.

Figure 2:
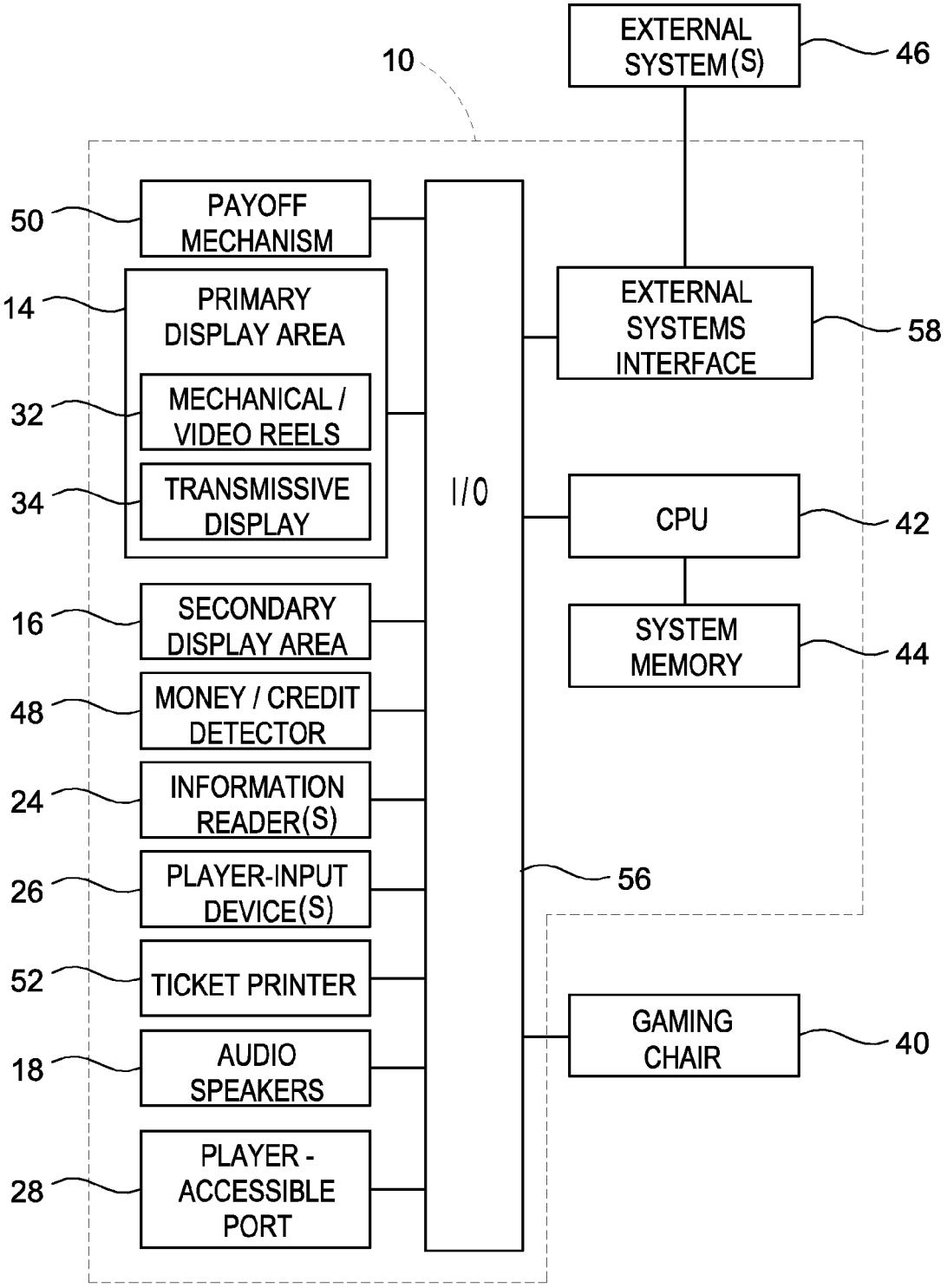
FIG. 2 is a schematic diagram of an exemplary gaming system with a gaming chair in accordance with aspects of the present disclosure.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor such as, for example, an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device(s). The controller 42 can use a random number generator (RNG) to randomly generate a wagering game outcome from a plurality of possible outcomes. Alternatively, the outcome can be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and/or multiple program memories. The money/credit detector 48 signals the processor 42 that money and/or credits have been input via a value-input device, such as the bill validator 20 or coin acceptor 22 of FIG. 1, or via other sources, such as a cashless gaming account, etc. These components can be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, the gaming chair 40, and a payoff mechanism 50. The payoff mechanism 50 is operable, for example, in response to instructions from the controller 42 to award a payoff to the player in response to certain winning outcomes that might occur in the base game, the bonus game(s), or via an external game or event. The payoff can be provided in the form of money, redeemable points, services or any combination thereof. Such payoff can be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44. Additionally, for example, the controller 42 can regulate the actuation and modulation of one or more haptic tactors (discussed below with respect to FIGS. 7-9) and/or one or more thermal devices (discussed below with respect to FIGS. 14-17) disposed in, on, or near the gaming terminal.

In some embodiments, the controller 42 is also connected to, and controls, the gaming chair 40. For example, the controller 42 can regulate the actuation and modulation of one or more haptic tactors (discussed below with respect to FIGS. 5-9) and/or one or more thermal devices (discussed below with respect to FIGS. 11-17) disposed in, on, or near the gaming chair 40. Moreover, the controller 42 can be configured to regulate an emotive lighting assembly 38 disposed in the backrest assembly of the gaming chair 40 to create a preferred gaming ambiance and/or a predetermined gaming experience. In this regard, the audio output of a speaker package 39 in the gaming chair 40 can also be controlled by the controller 42. A number of optional audio and lighting features that may be incorporated into the gaming chair 40 (or any of the other embodiments disclosed herein) are disclosed in commonly owned U.S. patent application Ser. No. 12/944,880, to Paul M. Lesley et al., which was filed on Nov. 12, 2010, and is incorporated herein by reference in its entirety. Additional information regarding speaker systems for gaming devices and gaming chairs is disclosed in commonly-assigned U.S. Patent Application Publication No. 2008/0211276 A1, to James M. Rasmussen, filed on Dec. 19, 2007, which is also incorporated herein by reference in its entirety.

Communications between the controller 42 and both the peripheral components of the gaming terminal 10 and the external system 46 occur through input/output (I/O) circuit 56, which can include any suitable bus technologies, such as an AGTL+ front side bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 may be connected to an external system interface 58, which is connected to the external system 46. In the exemplary configuration illustrated in FIG. 2, the controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

The controller 42 of FIG. 2 comprises any combination of hardware, software, and/or firmware now known or hereinafter developed that may be disposed or reside inside and/or outside of the gaming terminal 10, and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 can communicate with the external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Security features may be advantageously utilized where the gaming terminal 10 communicates wirelessly with the external system(s) 46, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 56), and authentication servers (AS) (e.g., an external system 46), which provide authentication services to STAs. Information regarding security features for wireless networks may be found, for example, in the National Institute of Standards and Technology (NIST), Technology Administration U.S. Department of Commerce, Special Publication (SP) 800-97, ESTABLISHING WIRELESS ROBUST SECURITY NETWORKS: A GUIDE TO IEEE 802.11, and SP 800-48, WIRELESS NETWORK SECURITY: 802.11, BLUETOOTH AND HANDHELD DEVICES, both of which are incorporated herein by reference in their respective entireties.

Referring now to FIG. 3, an image of a basic-game screen 60 adapted to be displayed on the primary display area 14 of FIG. 1 is illustrated, according to one embodiment of the present disclosure. A player begins play of a basic wagering game by providing a wager (e.g., inserting a cash note or substitute currency media into the validator 20, and/or inserting a player-card into information reader 24). A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The player-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation, animation, or other indicia, and may further include a "blank" symbol.

Symbol combinations may be evaluated as line pays or "scatter pays". Line pays may be evaluated left to right, right to left, top to bottom, bottom to top, or any combination thereof by evaluating the number, type, or order of symbols 90 appearing along an activated payline 30. Scatter pays, on the other hand, are evaluated without regard to position or paylines, and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown, a gaming terminal with any plurality of reels may also be used in accordance with the present disclosure.

Figure 4:
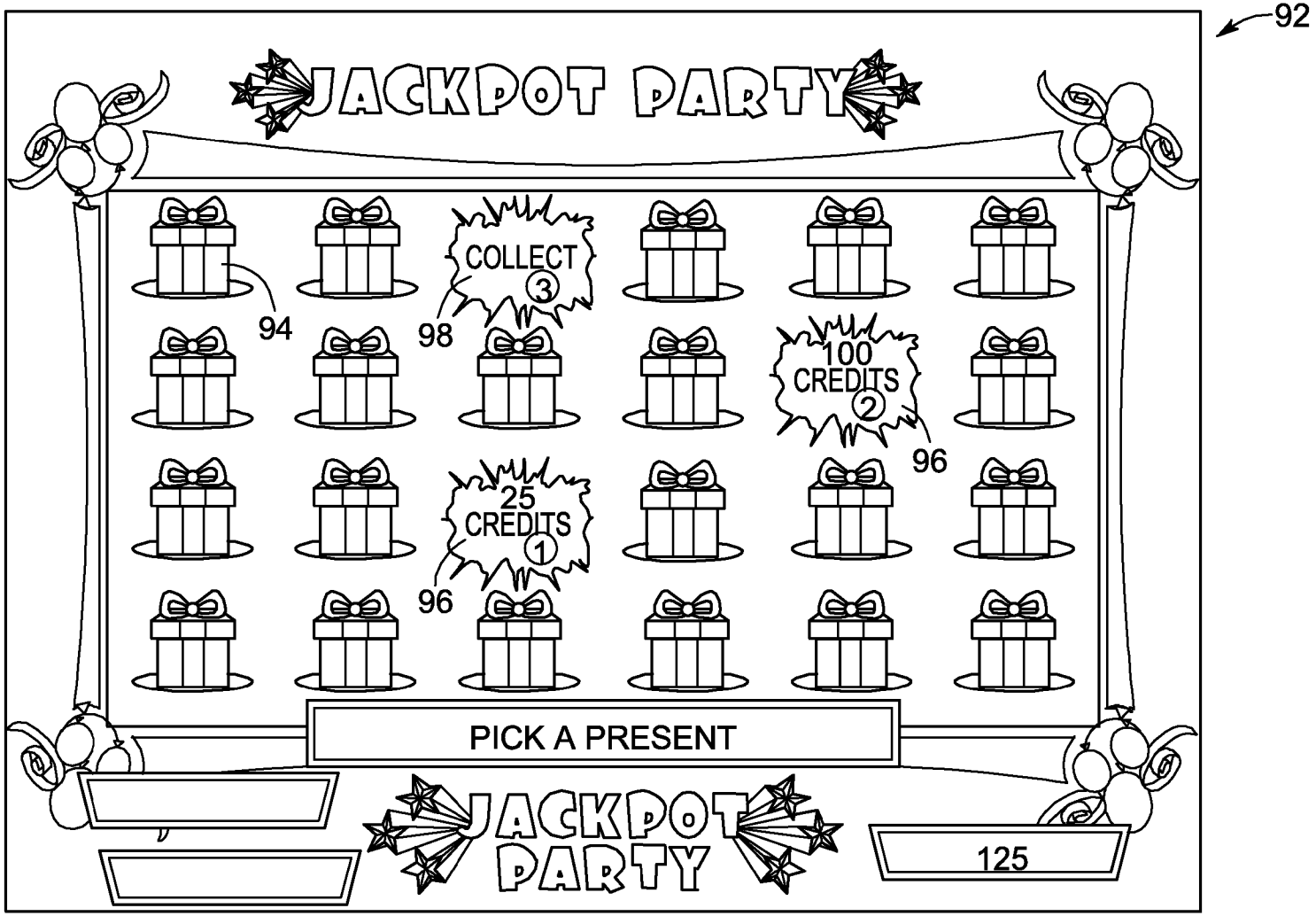
FIG. 4 is a screen shot of a bonus-game screen of an exemplary wagering game that can be played on the gaming terminal of FIG. 1 and/or the gaming system of FIG. 2.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
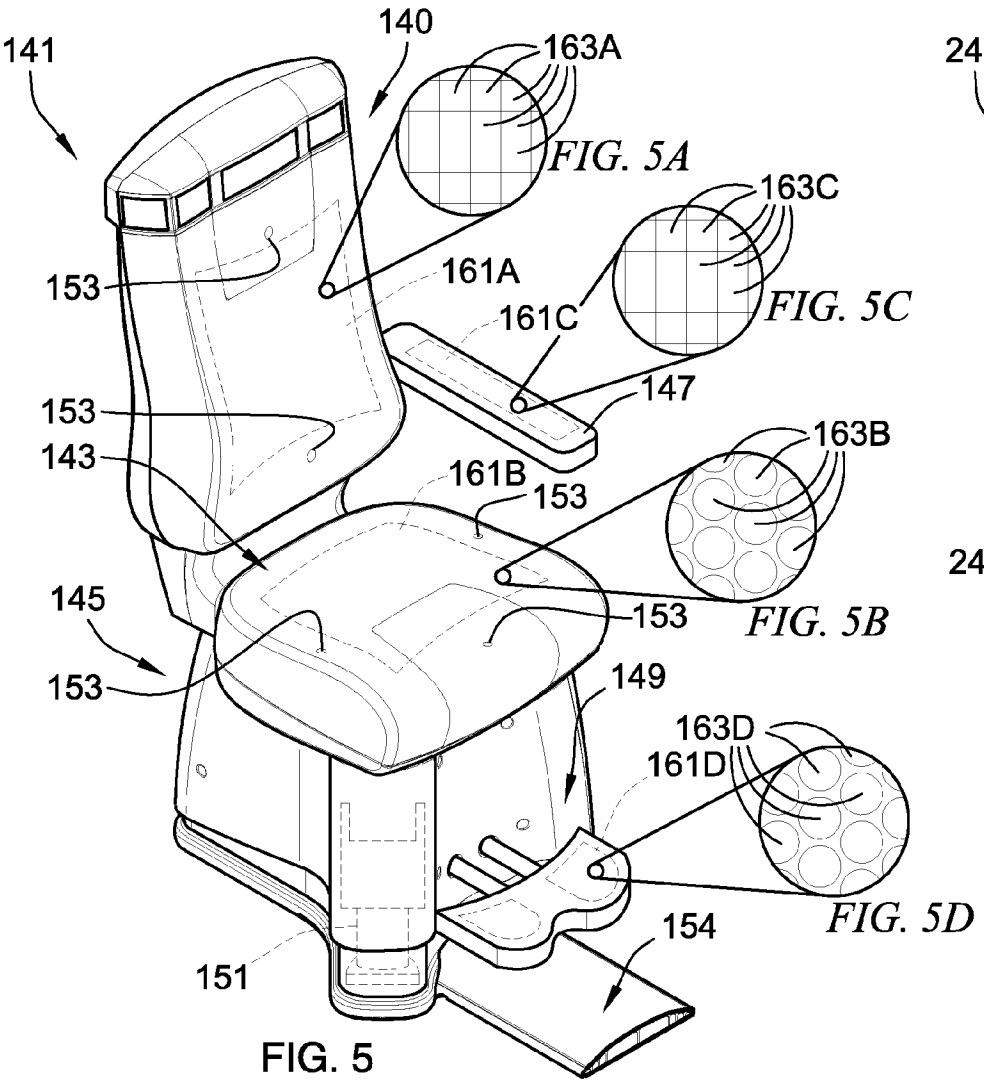
FIG. 5 is a front perspective-view illustration of an exemplary haptic gaming chair in accordance with aspects of the present disclosure.

Referring now to FIG. 5, a perspective-view illustration of a representative haptic gaming chair 140 (also referred to herein as "gaming machine chair" and "gaming chair") for a wagering game system, a wagering game machine, and/or a wagering game device is presented in accordance with aspects of the present disclosure. The gaming chair, which is indicated generally as 140 in FIG. 5, generally includes a backrest assembly (or "seatback" or "backrest portion") 141 and a seat assembly (or "seat bottom" or "seat portion") 143, both of which are functionally supported on a platform assembly (or "base") 145. The backrest and seat portions 141, 143 may be swivel-mounted to the platform assembly 145 to ease ingress to and egress from the gaming chair 140. Moreover, the height and angle of the backrest portion 141 and the seat portion 143 can be individually and/or collectively adjustable. A footrest 149 projects generally horizontally from a lower, forward portion of the exemplary platform assembly 145. It should be recognized that the disclosed concepts are not limited to the chair design presented in the drawings, but rather can be applied to other chair designs. For instance, the disclosed concepts can just as easily be incorporated into a gaming chair without an armrest, without a footrest, with different cushions, with a different base, or any logical combination thereof.

Communication between the gaming chair 140 and a gaming machine (e.g., the gaming terminal 10 of FIG. 1) or a gaming system (e.g., the exemplary gaming system of FIG. 2) can be accomplished in a variety of ways, including wireless transceivers (i.e., wireless communications), direct connectivity (i.e., wired communications), or otherwise. Similar to the embodiment of FIG. 1, for example, the gaming chair 140 of FIG. 5 includes a sled 154 with an internal wiring harnesses (not shown), which electrically and mechanically couples the gaming chair 140 to a gaming machine or a gaming system. The gaming chair 140 can also be operable to receive an input from a player through various input devices such as, for example, a button panel, a joystick, a mouse, or a motion sensor(s) (not shown) located, for example, on a pivotable armrest 147 (only one of which is shown in FIG. 5, but an identical counterpart may be pivotably attached to the opposing side of the backrest portion 141). Other features of the gaming chair 140 may include, but are not limited to, a ticket printer, a card read/write device, a cup holder, foldout tray, a headphone jack, volume controls, brightness controls, cushion heaters, and a retractable tape for restricting use of the gaming chair 140 and/or corresponding gaming machine/system. Additional chair features and design options that may be incorporated into the haptic gaming chair 140 (or any of the other embodiments disclosed herein) are disclosed in commonly-assigned U.S. Patent Application Publication No. 2008/0054561 A1, to Stephen A. Canterbury et al., filed in the U.S. on Sep. 21, 2007 and entitled "Gaming Machine Chair," which is incorporated herein by reference in its entirety.

The platform assembly, designated generally as 145, provides functional and operational support for the backrest and seat assemblies 141, 143. The platform assembly 145 may be a rigid, stationary structure that is designed solely to provide operative support to the remainder of the haptic gaming chair 140. In an optional configuration, the platform assembly 145 can be operable to automate movement of the gaming chair 140 to provide, for example, simulated motions related to events occurring during game play or events unrelated to game play. That is, one or more actuators can be incorporated in the platform assembly 145 that can be operatively attached to, and selectively actuable for moving, the gaming chair backrest portion 141, the seat portion 143, and/or the base 145, individually or in any combination. In a non-limiting example, three brushless DC-motors with ball screws (one of which is shown hidden at 151) can be located underneath the seat portion 143. The actuators can be operated to provide any of a variety of movements, including, but not limited to, heave (upward and downward rectilinear movement), surge (forward and rearward rectilinear movement), sway (lateral rectilinear movement), pitch (rotational movement about a lateral axis), roll (rotational movement about a longitudinal axis), and yaw (rotational movement about a vertical axis). By way of non-limiting example, the requisite hardware and software for providing the aforementioned automation of the gaming chair 140 (or any of the other embodiments disclosed herein), as well as related gaming features, can be found in commonly owned U.S. patent application Ser. No. 12/944,862, to Paul M. Lesley et al., which was filed on Nov. 12, 2010, and is incorporated herein by reference in its entirety.

The gaming chair 140 can also include a variety of sensing devices 153 that are operable, independently or through cooperative operation, to detect the position of the player relative to the gaming chair 140. There are numerous types of sensing devices 153 that can be used, including, for example, acoustic sensing devices (e.g., ultrasonic sensors), thermal sensing devices (e.g., infrared sensors), optical sensing devices (e.g., light-based and laser-based sensors), capacitive sensing devices (e.g., capacitive-based proximity sensors), pressure sensors (e.g., silicon piezoresistive pressure sensors), combinations thereof, and/or the like. These sensors 153 can be located at innumerable locations with respect to the gaming chair 140 (e.g., mounted inside the backrest portion 141 and/or seat portion 143). The information generated by the sensors 153 can be analyzed, for example, to determine how the player is positioned relative to the gaming chair 140. If automated, the motion of the gaming chair 140 can be selectively modified based on the occupant's position and/or movement relative to the gaming chair 140 as indicated by the aforementioned sensors 153. In addition, the audio and visual presentation of the wagering game can be modified depending upon the detected position of the player. Additional options and features relating to gaming chair sensors are disclosed in commonly owned U.S. Provisional Application No. 61/409,164, which was filed on Nov. 2, 2010, and is incorporated herein by reference in its entirety.

In accordance with the present embodiment, an array of tactile actuators, or "tactors," is operatively connected to and may be at least partially embedded within a portion or selected portions of the haptic gaming chair 140. As used herein, the terms "tactor" or "tactile actuator" can be defined to refer to a transducer, actuator, or other similar device that is configured to provoke player stimulation through the sense of touch. In the embodiment illustrated in FIG. 5, for example, a first matrix array of tactile actuators 161A is embedded inside the backrest portion 141 of the haptic gaming chair 140. The first matrix 161A extends approximately from the lower lumbar or "lower spine" region to the upper thoracic or "upper spine" region. As seen in FIG. 5A, the first matrix 161A comprises a number of individually actuable discrete tactile actuators 163A arranged in a first pattern (e.g., a plurality of linear columns and rows). A second matrix array of tactile actuators 161B is embedded inside the seat portion 143 of the haptic gaming chair 140. The second matrix 161B extends approximately from the buttocks or "rear pelvic" region to the lower hamstring or "lower femur" region. As seen in FIG. 5B, the second matrix 161B comprises a number of individually actuable discrete tactile actuators 163B arranged in a second pattern (e.g., staggered). FIGS. 5A and 5B schematically illustrate the first and second matrices 161A, 161B employing different layouts and types of tactile actuators 163A, 163B. Nevertheless, the first and second matrices 161A, 161B can utilize similar actuators, similar arrangements, or both.

The haptic gaming chair 140 presented in FIG. 5 also includes a third matrix array of tactile actuators 161C, which is at least partially embedded within the pivotable armrest 147. The third matrix 161C is shown extending approximately the entire length of the forearm, which can be relative to the ulna or radius. The third matrix 161C is shown in FIG. 5C comprising a number of individually actuable discrete tactile actuators 163C of a similar type and arrangement to those in the first matrix 161A. The exemplary haptic gaming chair 140 further includes a fourth matrix array of tactile actuators 161D that is at least partially embedded within the footrest 149. The fourth matrix 161D extends along the length of the instep of the human foot. As seen in FIG. 5D, the fourth matrix 161D comprises a number of individually actuable discrete tactile actuators 163D of a similar type and arrangement to those in the second matrix 161B. FIGS. 5C and 5D schematically illustrate the third and fourth matrices 161C, 161D employing different layouts and types of tactile actuators 163C, 163D. Nevertheless, the third and fourth matrices 161C, 161D can utilize similar actuators, similar arrangements, or both. In this vein, the tactors of the haptic gaming chair 140 can be varied from what is shown in the drawings, for example, to comprise different kinds of tactors, different tactor arrangements, different matrix locations, different matrix geometries, different matrix sizes, a different number of matrices, combinations thereof, and/or the like.

Each of the discrete tactors 163A, 163B, 163C, 163D is configured to generate a respective "discrete" tactile sensation. The tactors 163A, 163B, 163C, 163D can be used, as developed further below, to provide a means of exchanging information that replaces or supplements auditory and visual forms of communication. Moreover, the tactors 163A, 163B, 163C, 163D can be used to provide sensory enhancement (e.g., to simulate sensations that are part of the gaming experience), and to add a physical dimension to light shows and audio arrangements. The tactors 163A, 163B, 163C, 163D can provide a means for silent, generally invisible communication, especially in circumstances where audio and visual cues may be overlooked. For example, cues can be sent to players in situations where the audio and/or visual output is time delayed or in environments where hearing and/or seeing is difficult.

There are numerous types of tactors that can be used within the scope of the present disclosure; following are a number of non-limiting examples. One of the most common types of tactile actuators is the rotary-motion vibrating tactor, which consists generally of an eccentric mass coupled to a DC motor. Both the motor and the mass are enclosed in an outer housing that directly or indirectly contacts a player's skin. The rotation of the mass by the motor causes the housing to vibrate, which in turn is transferred to the player causing stimulation to the skin.

Linear-actuator tactors, or "voice-coil tactors" as they are more commonly known, are coil-based actuators that are directly or indirectly pressed against a player's skin. Linear-actuator tactors typically comprise a movable contacting element that is lightly preloaded against the skin or, in some aspects, can be embedded in a housing. When an electrical signal is passed through the coil, the contacting element oscillates along a path generally perpendicular to the skin.

Another exemplary form of tactor is the electrical tactile device, which generates the sensation of touch through electrotactile excitation (also known as electrocutaneous stimulation). In general, electrical tactile devices use tiny electrodes to produce stimulus-controlled, localized touch sensations by passing a small electric current through the skin. This current, in turn, generates an electric field that excites the neighboring afferent nerve fibers responsible for normal mechanical touch sensations.

Pneumatic tactors are similar in principal to the aforementioned linear actuators, typically consisting of a "hard" shell with a "soft" membrane covering an opening of the shell. Oscillatory compressed air, which is driven into the plastic shell, for example, through an air supply tube, forces the soft membrane to vibrate. The oscillatory compressed-air signals are typically generated by solenoid valves configured to selectively isolate a pressurized air line that is connected to either a compressor or pressurized air tank.

Another type of tactile actuator that can be employed by the various haptic gaming chairs disclosed herein include active-material based actuators. Active materials include those compositions having certain properties, such as stiffness, shape, and dimension, that can be selectively altered through the introduction of an external stimuli or "activation signal," such as external stresses, temperature, moisture, and pH changes, and electric or magnetic fields, depending upon the type of active material. Two common types of active materials are piezoelectric materials and electroactive polymers.

Piezoelectric materials are materials, traditionally crystalline structures and ceramics, which produce a voltage when a mechanical stress is applied thereto. Since this effect also applies in the reverse manner, a voltage applied across a sample piezoelectric material will produce a mechanical stress within the sample (e.g., an expansion or contraction). Piezoelectric based devices are typically linear or linear inertial type tactors that use the properties of piezoelectric materials to produce vibratory stimulus.

Electroactive polymers are a category of smart materials that are polymer based and react in the presence of an electric current. Electroactive Polymers, or more commonly EAPs, include those polymeric materials which respond to external electrical stimulation, i.e., an applied voltage, by displaying a significant shape or size displacement. Consequently, EAPs are capable of converting energy in the form of electric charge and voltage to mechanical force and movement and vice versa.

Figure 6:
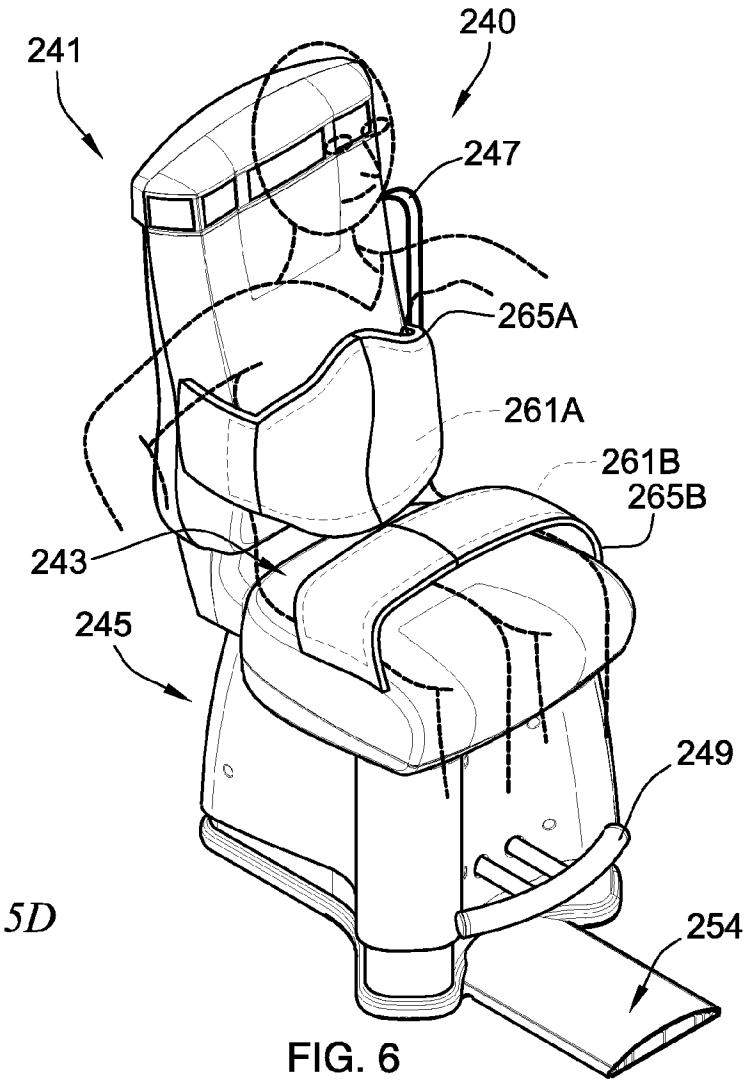
FIG. 6 is a front perspective-view illustration of another exemplary haptic gaming chair in accordance with aspects of the present disclosure.

Turning next to FIG. 6, wherein similar reference numerals refer to similar components from the other figures, a front perspective-view illustration of another exemplary haptic gaming chair, designated generally as 240, is shown in accordance with aspects of the present disclosure. Similar to the embodiment of FIG. 5, the haptic gaming chair 240, which is likewise referred to herein as "gaming machine chair" or simply "gaming chair," generally includes a backrest assembly (or "seatback" or "backrest portion") 241 and a seat assembly (or "seat bottom" or "seat portion") 243, both of which are functionally supported on a platform assembly (or "base") 245. An armrest 247 is pivotally mounted to the side of the backrest assembly 241. Projecting from a lower, forward portion of the exemplary platform assembly 245 is an adjustable footrest 249. The gaming chair 240 can be configured to be functionally and operationally similar to the haptic gaming chair 140 of FIG. 5 and, thus, can include any of the features described above (or below, for that matter). Consequently, for brevity and conciseness, these components will not be described again in detail.

The gaming chair 240 of FIG. 6 comprises what is generally referred to herein as a "haptic apron." As used herein, a "haptic apron" is a shroud that covers a portion of the player's body and includes a number of discrete tactors, such as those illustrated in FIGS. 5A-5D and discussed above. In the illustrated embodiment, for example, the gaming chair 240 includes two haptic aprons: a haptic vest 265A (or "first haptic apron") and a haptic leg strap 265B (or "second haptic apron"). Although not so restricted, the haptic vest 265A is operatively attached to the backrest portion 241 of the gaming chair 240, whereas the haptic leg strap 265B is operatively attached to the seat portion 243 of the gaming chair 240. The haptic vest 265A, as shown, wraps around the lateral and frontal surfaces of the player's torso, in an opposing spaced relationship with the corresponding midsection of the backrest 241 (e.g., facing the first matrix of tactile actuators 261A). The haptic leg strap 265B, on the other hand, wraps around the lateral and frontal surfaces of the players left and right quadriceps, in an opposing spaced relationship with the corresponding section of the seat assembly 243 (e.g., facing the second matrix of tactile actuators 161B).

It is contemplated that in some alternative embodiments, the gaming chair 240 may include a single haptic apron and, in other alternative embodiments, the gaming chair 240 may include a one or more haptic aprons in addition to the haptic aprons 265A, 265B shown in FIG. 6. Additionally, it is contemplated that, in some alternative embodiments, the first and second haptic aprons 265A and 265B may be combined into a single-piece structure, may be positioned at additional or alternative locations relative to the constituent sections of the gaming chair 240, and/or may be provided as a separate, albeit operatively attached, component of the haptic gaming chair 240.

The haptic vest 265A is shown in FIG. 6 with a first array of tactors 261A at least partially embedded therein, each of which is configured to generate a respective "discrete" tactile sensation. In a similar respect, a second array of tactors 261B, which is separate from the first array 261A, is at least partially embedded within the haptic leg strap 265B. Each of the haptic aprons 265A, 265B cooperates with a section of the haptic gaming chair 240 (e.g., the backrest portion 241 and the seat portion 243, respectively) to circumscribe a corresponding periphery of the player. According to aspects of the present disclosure, the actuation of the array of tactors 261A, 261B in the haptic apron 265A, 265B can be synchronized or otherwise coordinated with the actuation of tactors embedded within the gaming chair 240 (e.g., the first and second tactor matrices 161A, 161B presented in FIG. 5) to generate tactile stimulation along the entire periphery of the player, including selected sections thereof, as developed in further detail below. In so doing, the present concepts envision imparting 360 degrees of haptic stimulation to the player during game play. In a non-limiting scenario, the tactors in the haptic vest 265A and backrest portion 241 can be collaboratively modulated in any desired predetermined sequence, for example, to simulate a swirling- or eddy-like event in the wagering game. For instance, starting on the front-center of the player's chest, the tactors in the haptic vest 265A can be sequentially activated in a counterclockwise direction, with respect to FIG. 6, moving circumferentially along the player's torso towards the right-hand side of the backrest 241, then activating the tactors in the backrest portion 241 aligned along the player's back, and back to the tactors 261A in the haptic vest 265A aligned along the left-hand side of the player's torso (when viewed in FIG. 6).

Figure 7:
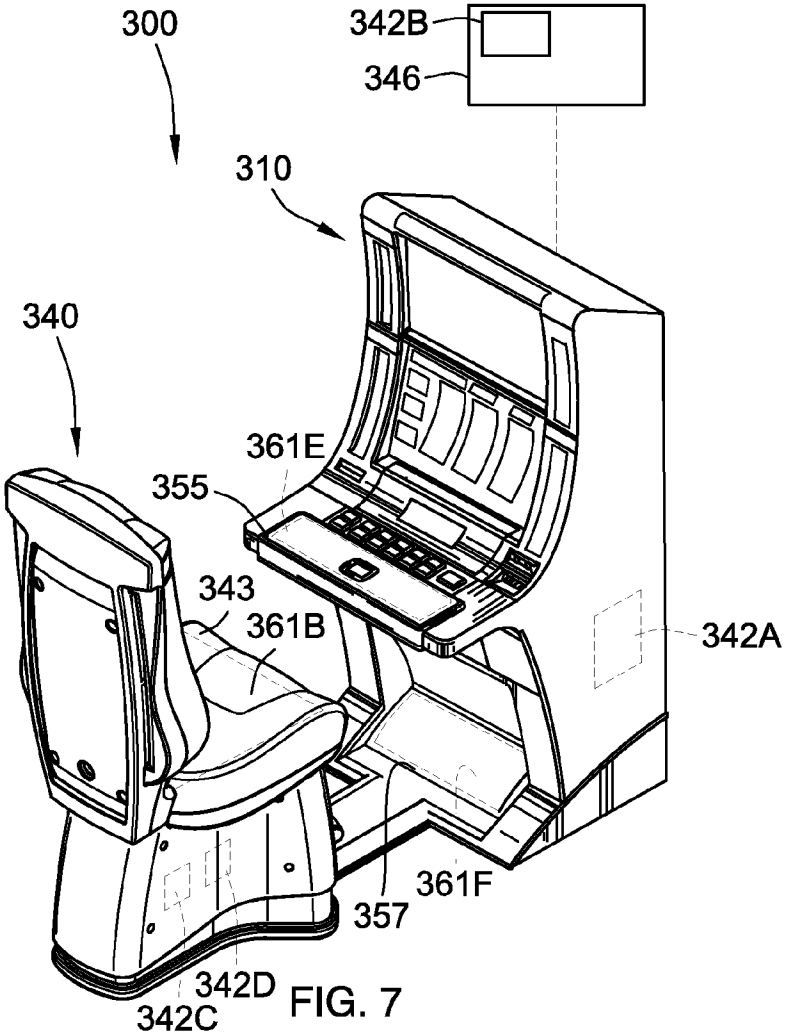
FIG. 7 is a perspective-view illustration of an exemplary gaming system with a haptic gaming chair in accordance with aspects of the present disclosure.

With reference to FIG. 7, a perspective-view illustration of an exemplary gaming system, designated generally at 300, is presented in accordance with aspects of the present disclosure. The gaming system 300 is shown generally comprising a haptic gaming terminal 310 and a haptic gaming chair 340, which are communicatively coupled to an external gaming system 346. The haptic gaming terminal 310 can be similar in function, operation and connectivity to the gaming terminal 10 discussed above with respect to FIGS. 1 and 2. Accordingly, the haptic gaming terminal 310 can include any of the corresponding features described above. In a similar regard, the haptic gaming chair 340 can be similar in function, operation and connectivity to the haptic gaming chair 40 of FIG. 1, haptic gaming chair 140 of FIG. 5, or the haptic gaming chair 240 of FIG. 6, or combinations of selected aspects therefrom, and therefore can include any of the related features described above. Consequently, for brevity and conciseness, these components will not be described again in detail.

In accordance with the present embodiment, an array of tactile actuators, or "tactors," is operatively connected to and may be at least partially embedded within a portion or selected portions of the haptic gaming terminal 310. In the embodiment illustrated in FIG. 7, for example, a first matrix array of tactile actuators 361E is embedded inside a hand rest (also known as "wrist rest") portion 355 of the haptic gaming terminal 310. The first matrix 361E comprises a number of individually actuable discrete tactile actuators, which may be in the form of any of the tactile actuators described above. A second matrix array of tactile actuators 361F is embedded inside a footrest portion 357 of the haptic gaming terminal 310. The second matrix 361F, like the first matrix 361E, comprises a number of individually actuable discrete tactile actuators, which may be in the form of any of the tactile actuators described above. It should be recognized that the first and second matrices of tactile actuators 361E, 361F can be varied from what is shown in FIG. 7, for example, to comprise different kinds of tactors, different tactor arrangements, different matrix locations, different matrix geometries, different matrix sizes, a different number of matrices, combinations thereof, and/or the like.

Operation of the gaming system 300 of FIG. 7 is by way of one or more controllers. Specifically, the various components of the gaming terminal 310 can be controlled by a central processing unit (CPU) 342A, either alone or in collaboration with one or more external controllers and processors. The CPU 342A can include any of the options and features described above with respect to the CPU 42 of FIG. 2. To provide gaming functions, for example, the controller 342A executes one or more game programs stored in one or more computer readable storage media in the form of memory or other suitable storage device(s). The controller 342A can use a random number generator (RNG) to randomly generate a wagering game outcome from a plurality of possible outcomes. Alternatively, the outcome can be centrally determined using either an RNG or a pooling scheme at a remote controller included, for example, within the external system 346. It should be appreciated that the controller 342A may include, in any combination, one or more microcontrollers, volatile memory, non-volatile memory, and/or one or more microprocessors, including but not limited to a master processor, a slave processor, and a secondary or parallel processor.

The external gaming system, schematically illustrated at 346 in FIG. 7, comprises a controller 342B that may be similarly configured in accordance with any of the optional configurations and features described above with respect to the CPU 42 of FIG. 2. In some optional embodiments, the controller 342B takes on the form of a central server, central controller, or remote host that communicatively links to the gaming terminal 310 to other gaming terminals or gaming systems, for example, through a data network or remote communication link. In some representative arrangements, the controller 342B is a community controller, which controls at least a community portion of a wagering game. To that end, the haptic gaming terminal 310 and haptic gaming chair 340 can be designed to transmit and receive from the controller 342B events, messages, commands, and/or any other suitable data or signals.

The various components of the haptic gaming chair 340 can be controlled by a motion controller 342C, either alone or in collaboration with an emotive lighting and display controller 342D or one or more external controllers and processors. The gaming chair controllers 342C, 342D can be manufactured with the appropriate hardware and software to respond to signals from the gaming machine (e.g., the terminal CPU 342A) and/or the gaming system (e.g., the external gaming system controller 342B) as directed by the gaming software, or to respond to input from the player, for controlling gaming functions provided by the haptic gaming chair 340. For example, in one embodiment, the motion controller 342C and emotive lighting and display controller 342D each includes a respective printed circuit board (PCB) with various components, such as a microprocessor. The controllers 342C, 342D can be enclosed in a grounded material suitable to shield the controller from external interference such as electrostatic, radio frequency, and magnetic energy.

In some embodiments of the present disclosure, the various tactors/tactor arrays in the gaming system 300 (e.g., those embedded within or operatively connected to the haptic gaming terminal 310, the haptic gaming chair 340, or both) respond to signals received from the controller 342B in the external gaming system 346, the CPU 342A in the gaming terminal 310, the motion controller 342C of the gaming chair 340, the emotive lighting and display controller 342D of the gaming chair 340, and/or any combination thereof.

The controller(s) can synchronize actuation of one or more of the disclosed arrays of tactors to coincide with aspects of the wagering game. For example, actuation of one or more of the disclosed arrays of tactors can be synchronized with an event that is currently being displayed by a gaming display device (e.g., to coincide with an incident or element associated with a basic game, bonus game, progressive game, community game, etc.). For instance, the tactors can be employed to effectuate the sensation of fluid turbulence, for example, during a feature in the wagering game where the player is flying. Another non-limiting example includes synchronizing actuation of the array of tactors to thereby create for the player a sensation of contact with one or more objects being displayed via the display device. One representative scenario includes modulating the tactors to create the sensation of fluid waves splashing into the player or, alternatively, the player being struck by a tackle in a football-type or rugby-type gaming feature. To that end, the tactors can be individually and collectively modulated to simulate the movement of an object across a surface of the player's body. A haunted-house gaming feature, as one non-limiting instance, may depict spiders and scorpions crawling across a display screen, which may be accompanied with discrete tactile stimulations by one or more tactors to simulate the sensation of the spiders and scorpions walking across the player's body. In another instance, the tactors can be individually and collectively modulated to simulate objects or effects implied by an audio system or an external device.

In additional or alternative embodiments, actuation of one or more of the disclosed arrays of tactors can be synchronized or otherwise controlled to create a virtual animation. The tactor animation may be pre-rendered like a cartoon and played back as appropriate. By way of non-limiting example, an artist or haptic effects designer can design a haptic experience in a manner similar to the way in which animations are currently drawn. An array of pixels of a display device, which can optionally display the animation contemporaneous with actuation of the tactors, corresponds to the array of tactors. Each frame of the animation can correspond to a specific interval for stimulating the tactors. For example, a frame might be 20 milliseconds. The color or brightness of the pixel can correspond to some characteristic of driving the tactor. For example, the brightness of the pixel can correspond to the intensity of driving the associated tactor.

In additional or alternative embodiments, actuation of one or more of the disclosed arrays of tactors can be synchronized with an event that was previously displayed or, alternatively, will subsequently be displayed by a gaming display device. In regard to the former, the tactors can be employed to indicate events that have already happened, for example, simulating the Doppler effect—the delayed onset of sound and/or wind generated by an object, such as a plane or automobile, that has already passed by the player. Alternatively, with regard to the latter, the tactors can be varied to foreshadow events that are about to happen, such as simulating the vibrations generated by a stampede of horses before they are heard or seen by the player (e.g., via the display and speakers in the gaming system, respectively).

The controller(s) can also synchronize or otherwise coordinate actuation of one or more of the array of tactors to thereby elicit a predetermined reflex by the player. In the aforementioned haunted-house example, replicating the sensation of insects or other creatures crawling across the player's body can be utilized to elicit a sense of trepidation or nervousness. The tactors in the seat assembly can be actuated in a like manner to get the player to jump or even potentially scream, which can bring about a sense of excitement and exhilaration. An additional positive effect is the commotion will bring attention from surrounding patrons to the wagering event. Similarly, a sense of urgency or exigency can be created, e.g., through the haptic simulation of the ever-increasing palpation rate of a beating heart, which can be used to compel the player to act more quickly.

The controller(s) can also synchronize or otherwise coordinate actuation of the tactors to thereby create a tactile pattern on the player. For example, shooting stars, bouncing balls, and rolling die can be made more readily perceptible to the player when the player, in addition to seeing and or hearing the object, feels the actual shape (and or movement) of the object on their body. This feature can also be employed, for example, to get the player to look or move in a particular direction and, thus, draw attention to a particular portion of the game display, a particular section of the game terminal, as well as other locations within the gaming establishment. For instance, the tactors can be synchronized to create the tactile sensation of an arrow scrolling to the left (or right) across the player's back to get the player to look or move left (or right).

The controller(s) can also synchronize or otherwise coordinate actuation of one or more arrays of tactors to thereby create for the player a sensation of physical transport without repositioning or reorienting portions of the player's body. In a typical full-motion chair, dynamic aspects of the wagering game are generally simulated by moving the backrest or seat assembly, or both, upwards, downwards, side-to-side, front-to-back, etc., by one or more large actuators. Concomitantly, the player's entire body (or selected sections thereof) is reoriented or otherwise repositioned. In contrast, the disclosed concepts do not require moving or repositioning entire sections of the gaming chair or, for that matter, entire sections of the player. That is, the discrete tactors can be synchronized to generate tactile stimulation that recreates the sensation of movement, such as sway, pitch, yaw, heave, and the like, without changing the position or orientation of the player. This feature, in turn, eliminates anxiety and discomfort, potential safety concerns, as well as the various other above-described disadvantages that may be associated with full-motion gaming chairs.

A community gaming example may include a plurality of haptic gaming chairs (e.g., four) that are communicatively coupled as part of a terminal bank. In this example, all of the players in the gaming chairs would be prompted to watch a shared "community display," such as a large plasma-screen located above the terminal bank in proximity to the individual gaming terminals. Each terminal, and thus each player, can be designated 1-4, respectively, with the player on the far left being designated one and the player on the far right being designated four. The tactile actuators in the four gaming chairs can be coordinated to simulate the virtual movement of an object, such as a gust of wind, a swarm of bugs, or stampede of buffalo, across the chairs and the respective surfaces of the four player's bodies in synchronicity with the shared display screen as the object(s) moves, for example, from the far left to the far right of the "community display". Using the haunted-house gaming feature as an example, as spiders are shown crawling across the display screen starting from the left, which would primarily be in player one's field of vision, the tactile simulation of the spiders crawling across the player's body would only at first be present in the chair for player one. As the spiders move to the right, each player would feel the tactors engage as the spiders moved into their field of vision, so in this case player two would feel the tactors engage next, then player three and then player four, in perfect coordination with the video display. This application can also apply to linked terminals in a bank that are not sharing a display screen. So, in the same haunted-house gaming feature example, the spiders can be shown crawling across a display screen of each individual player's terminal, sequentially moving from the left-most player (e.g., player one), continuing through the two intermediate players (e.g., players two and three), to the right-most player (e.g., player four). The tactile actuators can be operated in perfect synchronicity between games so that player one would feel the spiders first, moving from left to right on his screen and with the actuators triggering from left to right in synchronization with the video, then as the spiders appeared on the left side of player two's screen, she would feel the spiders move across her from left to right, etc. through player 4.

In both of these scenarios, the spiders can start from one terminal (e.g., the left-most terminal), and successively fill the screens of the remaining terminals (e.g., move from the left-most terminal to the right-most terminal). Once all of the players' screens are filled with spiders, all four players would feel the tactors activating across their backs simultaneously, giving them a shared sense of nervousness, excitement, and perhaps provoking them all to scream together, bringing a new shared sense of excitement and commotion that would bring attention from surrounding patrons to the wagering event. Alternatively, the spiders could be moving left to right in smaller numbers such that none of the screens are ever completely filled with spiders. Therefore, each individual player would only feel the tactors activating when the spiders were actually moving in his/her field of vision on either a shared screen or on an individual terminal screen. In this scenario, each player can feel the simulation of the spiders crawling across his/her body individually, with each player perhaps screaming sequentially from left to right. This could create tremendous anticipation and nervous excitement in the player at the far-right terminal as she hears each player in the bank reacting, with the exclamations coming closer and closer to her and then finally feeling the tactors activate across her own body in synchronization with the video in front of her.

Figure 8:
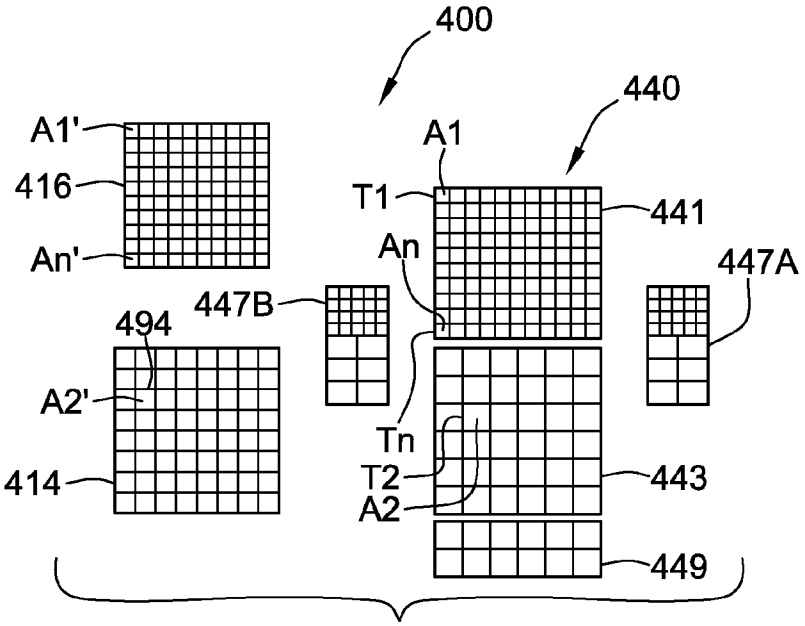
FIG. 8 is a schematic illustration showing the correlation between a number of gaming-system display devices and the tactor matrices embedded within various representative sections of an exemplary haptic gaming chair.

FIG. 8 is a schematic illustration of a representative gaming system 400 provided to show how sections of one or more gaming-system display devices, such as a primary display device (or display area) 414 and secondary display device (or display area) 416, coincide or are otherwise associated with segments of the tactor matrices embedded within various representative sections of an exemplary haptic gaming chair 440. The haptic gaming chair 440 of FIG. 8, which may be representative of and, thus, similar to any or all of the haptic gaming chairs described above, includes a backrest portion 441, a seat portion 443, a pair of pivotable armrests 447A and 447B, and an adjustable footrest 449. Each section of the haptic gaming chair 440 is shown comprising an array of individually actuable discrete tactile actuators, each of which is depicted schematically by a representative square. As seen in FIG. 8, each tactile actuator is arranged at a separate location with respect to a particular segment of the gaming chair 440. The locations of the tactile actuators each coincides with a respective location of one or more of the display devices. For example, a first tactor T1 is located at a first position A1 with respect to the backrest portion 441 that coincides with a first area A1' of the primary display device 414. Likewise, an n'th tactor Tn is located at an n'th position with respect to the backrest portion 441 that coincides with an n'th area An' of the secondary display device 416. Each pixel or bit-map of pixels can be assigned to or otherwise associate with a particular tactor.

Other additional or alternative embodiments include the tactor arrays being employed to recreate aspects of the screen layout, adding what may be considered a fourth dimension (4D) to a player's gaming experience. For instance, in the bonus game screen 92 illustrated in FIG. 4, the locations of the markers 94 can be indicated to the player through the actuation of correspondingly located tactors on the players back and/or hands. FIG. 8, for example, shows a similar player-selectable marker 494 that is located at a first marker location A2' on the primary display 412. The gaming system 400 can communicate the location (and "selectability") of the marker 494 to the player by actuating (and modulation) a tactor T2 positioned at a corresponding location A2 within the seat portion 443. Moreover, the player's selection and subsequent disappearance of one of the makers 94 on the bonus game screen 92 can also be communicated to the player through the increased stimulation and subsequent deactivation of a corresponding one or ones of the tactors. This feature can assist players with bad eyesight or poor hearing locate objects displayed on a display screen. Optionally, a player can even be provided with the option to select, modify, and/or purchase a tactile experience.

The disclosed concepts can be employed with free-standing gaming terminals (upright and slant top), countertop gaming machines, handheld gaming devices, etc. To that end, the disclosed concepts can be employed in solitary gaming, network gaming, community gaming, and bank gaming. Moreover, aspects of the disclosed concepts can be employed to send haptic sensations between terminals and, thus, between players. For example, actuation of the above-described tactors and tactor arrays can be coordinated so that players can virtually touch/contact one another. That is, the controller(s) can be configured to synchronize actuation of the array of tactors to thereby create for the player a sensation of physical contact with another player at another location.

Figure 9:
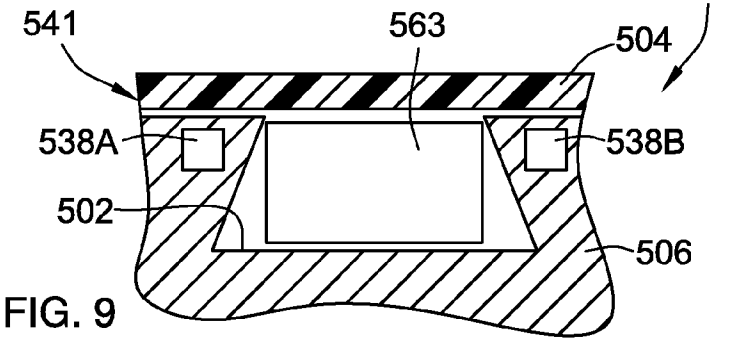
FIG. 9 is a schematic illustration of an exemplary tactor embedded within a representative section of an exemplary haptic gaming chair.

FIG. 9 is a schematic illustration of an exemplary tactor 563 that is embedded within a representative section, e.g., a cushion 506 of a representative backrest assembly 541, of an exemplary haptic gaming chair 540. The tactor 563 is nested inside a complementary cavity 502 and covered by an elastomeric sheet 504, through which vibrations/heat/stimulus generated by the tactor 563 can be transferred while insulating the tactor 563 from external contact. The haptic gaming chair 540 is also shown comprising a pair of lighting elements, such as first and second light-emitting diode (LED) lamps 538A and 538B, respectively, each of which is located within the backrest assembly 541 on opposing sides of the tactor 563. The actuation and intensity of the LED lamps 538A, 538B can be regulated to coincide with the intensity of vibration being generated by the tactor 563.

Figure 10:
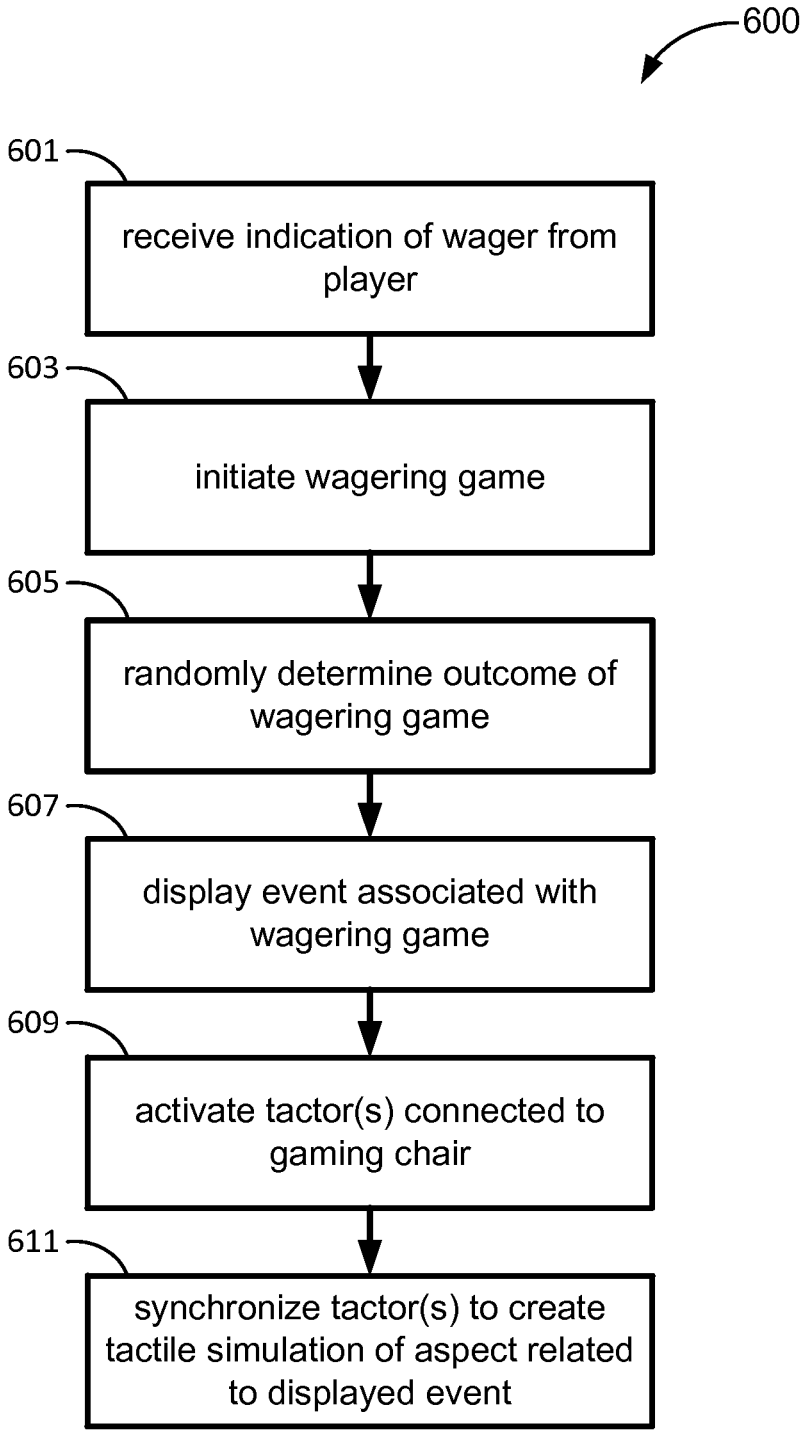
FIG. 10 is a flowchart for an algorithm that corresponds to instructions executed by a controller in accord with at least some aspects of the disclosed concepts.

With reference now to the flow chart of FIG. 10, an improved method 600 for conducting a wagering game in a gaming system is generally described in accordance with certain embodiments. FIG. 10 represents an algorithm that corresponds to at least some instructions that may be executed, for example, by the controller 42 and/or external systems 46 in FIG. 2 to perform any or all of the above and/or below described functions associated with the disclosed concepts. The instructions corresponding to the algorithm 600 can be stored on a non-transitory computer-readable medium, such as on a hard drive or other mass storage device or a memory device.

The exemplary algorithm 600 of FIG. 10 includes, at block 601, receiving an indication of a wager from a player to play the wagering game and, at block 603, responsively initiating the wagering game. The wagering game may include those wagering games described above with respect to FIGS. 3 and 4, or any other suitable wagering game. At block 605, the exemplary method 600 includes determining (e.g., via controller 42 of FIG. 2) an outcome of the wagering game. The wagering-game outcome is randomly determined from a plurality of wagering-game outcomes, for example, using a random number generator (RNG) in the manner disclosed above. One or more of the plurality of wagering-game outcomes constitutes a winning outcome for which a corresponding award is conferred upon the player. In addition or as an alternative to the foregoing, block 603 may comprise determining stop position(s) for a plurality of mechanical reels in the array.

The method 600 also includes, at block 607, displaying an event associated with the wagering game, e.g., via the primary display area 14 and/or secondary display area 16 of FIG. 1. This event may include the outcome of the wagering game, as determined at block 605. Alternatively, this event may be independent of the outcome of the wagering game and, in some embodiments, altogether unrelated to the wagering game. At block 609, one or more discrete tactors are activated. These tactors may be characterized in accordance with any of the above-described features and options. For example, the tactors can be embedded within a backrest portion or a seat portion of a haptic gaming chair, as described above with respect to FIG. 5. The exemplary algorithm 600 of FIG. 10 includes, at block 611, synchronizing actuation of the tactors to create for the player a tactile simulation of an aspect related to the event being displayed.

In some embodiments, the method 600 includes at least those steps enumerated above. It is also within the scope and spirit of the present invention to omit steps, include additional steps, and/or modify the order presented above. It should be further noted that the method 600 represents a single play of a wagering game. However, it is expected that the method 600 can be applied in a systematic and repetitive manner.

In the embodiments illustrated and described above, the haptic gaming chairs, the haptic gaming terminals, and/or the haptic gaming systems include one or more arrays of discrete tactors for providing tactile stimulation to the player. As described above, the one or more arrays of discrete tactors can be actuated to achieve certain haptic effects and tactile stimulations that otherwise may not be achieved by a single discrete tactor (e.g., a tactile pattern, a 360 degree tactile effect, a multi-dimensional simulated sensation, a multi-dimensional simulated movement, a simulated animation, a sensation of physical transport, etc.). However, some haptic effects contemplated by the present disclosure can also be achieved by a discrete tactor actuated independently of an array of discrete tactors. As such, according to some aspects of the present disclosure, the haptic gaming chairs, the haptic gaming terminals, and/or the haptic gaming systems can additionally or alternatively include one or more independent discrete tactors.

Figures 11, 11A:
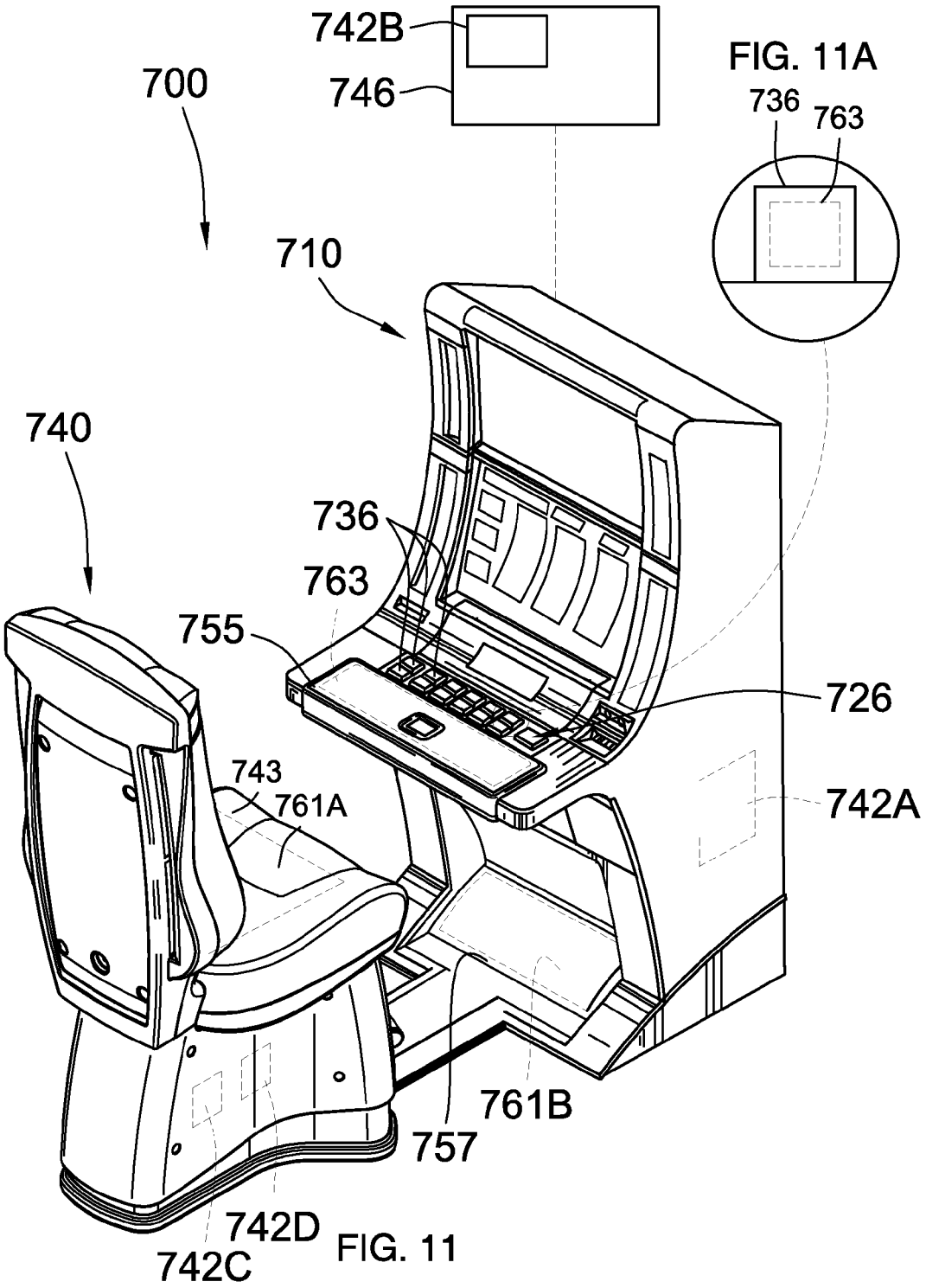
FIG. 11 is a perspective-view illustration of an exemplary gaming system with a haptic gaming chair in accordance with aspects of the present disclosure.
FIG. 11A is an enlarged schematic illustration of a tactor embedded within the exemplary haptic gaming terminal of FIG. 11.

FIG. 11 illustrates a perspective view of an exemplary gaming system 700 that includes a plurality of independent discrete tactors and a plurality of arrays of discrete tactors. The gaming system 700 includes a gaming chair 740 and a gaming terminal 710 that are similar in function, operation, and connectivity to the gaming chairs and gaming terminals described above. Accordingly, the haptic gaming terminal 710 can include any of the features illustrated and described above in connection with the gaming terminal 10 of FIGS. 1-2 and/or the gaming terminal 310 of FIG. 7. Similarly, the haptic gaming chair 740 can include any of the features illustrated and described above in connection with the haptic gaming chair 40 of FIG. 1, the haptic gaming chair 140 of FIG. 5, the haptic gaming chair 240 of FIG. 6, and/or the haptic gaming chair 340 of FIG. 7. Consequently, for brevity and conciseness, these components will not be described again in detail.

The gaming system 700 includes a first matrix array of discrete tactors 761A disposed in a seat portion 743 of the haptic gaming chair 740 and a second matrix array 761B of discrete tactors disposed in a footrest portion 757 of the haptic gaming terminal 710. The first matrix 761A and the second matrix 761B each comprise a number of individually actuable discrete tactors, which may be in the form of any of the tactors described above (e.g., a rotary-motion vibrating tactor, a linear-actuator tactor, an electrical tactile device, a pneumatic tactor, a piezoelectric material, an electroactive polymer, combinations thereof, and/or the like). Additionally, it is contemplated that the discrete tactors of the first matrix 761A and the second matrix 761B can be configured in any suitable matrix arrangement, location, geometry, size, combinations thereof, and/or the like as described above.

The gaming system 700 further includes an independent discrete tactor disposed in each of the buttons 736 on the player-input device 726. For example, FIG. 11A is an enlarged schematic illustration of an independent discrete tactor 763 disposed in a button 736. The discrete tactors 763 disposed in the buttons 736 can be in the form of the exemplary tactile actuators described above (e.g., a rotary-motion vibrating tactor, a linear-actuator tactor, an electrical tactile device, a pneumatic tactor, a piezoelectric material, an electroactive polymer, combinations thereof, and/or the like). It is contemplated that each of the independent discrete tactors 763 located within the buttons 736 can be of the same and/or a different form of tactor. Similarly, the tactors utilized as independent discrete tactors 763 can be in the same and/or a different form as the discrete tactors utilized in the matrix arrays of discrete tactors 761A, 761B of the gaming system 700.

Due to the close proximity of the buttons 736, the independent tactile actuators 763 and the buttons 736 can be configured to assist the player in discriminating the source of tactile stimulations produced by the tactors 763 disposed in the buttons 736. For example, the independent tactors 763 can be configured to provide relatively low energy haptic effects and/or each of the independent tactile actuators 763 and the buttons 736 can be isolated from the button panel 726 of the gaming terminal 710.

While the illustrated gaming system 700 includes an independent discrete tactor 763 disposed in each of the buttons 736 of the player-input device 726, a first array of discrete tactors 761A located in the seat portion 743 of the gaming chair 740, and a second array of discrete tactors 761B located in the footrest portion 757 of the gaming terminal 710, it is contemplated that more or fewer independent tactors and/or arrays of tactors can be included in the gaming system 700. It is also contemplated that the independent tactors and/or arrays of tactors can be positioned at additional or alternative locations in the gaming system. Also, as explained above, it is contemplated that the independent tactors and/or arrays of tactors can have shapes, sizes, and arrangements that are different than those shown and described for the gaming system 700. Additionally, it is contemplated that the gaming system 700 can include one or more of the haptic aprons (e.g., the haptic aprons 265A, 265B) described above, and that such haptic aprons can also include any number of independent tactors, arrays of tactors, and/or both.

The gaming system 700 further includes one or more controllers 742A-D (e.g., one or more of the controllers 342A-D described above) for operating the gaming system 700. In particular, the one or more controllers 742A-D are communicatively coupled to the first matrix of tactors 761A, the second matrix of tactors 761B, and each of the independent discrete tactors 763. As described above, the one or more controller(s) 742A-D can be configured to provide signals to actuate the first matrix of discrete tactors 761A, the second matrix of discrete tactors 761B, and/or the independent discrete tactors 763 to effectuate various aspects of a wagering game.

According to some embodiments of the present disclosure, the controller(s) 742A-D can be configured to actuate the arrays of tactors 761A, 761B and/or the independent tactors 763 to facilitate a skill mechanic of a wagering game. In some instances, the skill mechanics can be facilitated by actuating one or more of the arrays of tactors 761A, 761B and/or one or more of the independent tactors 763 to provide a precursory indication or cue relating to an aspect of a wagering game that has not yet occurred. The precursory indications or cues described herein can be distinguished from other tactile effects, which are instead generated in response to or concurrently with the occurrence of an aspect of a wagering game.

For example, in a reel-based wagering game that permits a player to manually stop a spinning reel, the controller(s) 742A-D can actuate one or more of the arrays of tactors 761A, 761B and/or one or more of the independent tactors 763 to provide a tactile indication of an advantageous or an optimal time (or time period) for the player to stop the spinning reel. If the player stops the spinning reel at the optimal time (or time period), the odds of certain advantageous symbols (e.g., a wild symbol) appearing in the randomly generated outcome of the wagering game may be increased. In one illustrative implementation of this example, the controller(s) 742A-D actuate the independent discrete tactor 763 located in one of the player-input buttons 736 such that the player can sense a precursory tactile cue as an indication of an advantageous time for the player to actuate the player-input button 736 to stop one or more of the reels in a display area. In another illustrative implementation, the first array of tactors 761A disposed in the seat portion 743 of the gaming chair 740 can be actuated to create a tactile sensation of a pattern that provides the precursory tactile cue indicative of the advantageous or optimal time to stop one or more of the spinning reels (e.g., a simulated ring that converges to a center point on the seat portion 743 of the gaming chair 740 such that the optimal time corresponds to the actuation of the discrete tactors at the center point).

As another non-limiting example, in a bonus game in which a player actuates a player input (e.g., one of the buttons 736) to throw a virtual dart at a dart board displayed on the display, the controller(s) 742A-D can be configured to actuate one or more of the independent tactors 763 and/or the arrays of tactors 761A, 761B to provide a precursory tactile cue that is indicative of an aiming alignment and a velocity of the dart to be thrown. In one illustrative implementation of this example, the controller(s) 742A-D can actuate the second matrix array of tactors 761B in a synchronized fashion to provide to the player a tactile sensation of a pattern (e.g., a repeated, lateral scrolling across the footrest portion 757 of the gaming terminal 710) that is indicative of the aiming of the dart to be thrown relative to the dart board displayed on the display. As one or more of the discrete tactors of the second array 761B are being actuated, the player actuates a player input (e.g., the player-input device 736) to set the aiming of the dart. The aiming of the dart set by the player corresponds to the relative location of the discrete tactor(s) of the second array 761B that were actuated at the time the player actuated the player-input button 736. Additionally, in this illustrative implementation, the controller(s) 742A-D can actuate the independent discrete tactor(s) 763 and/or the first array of tactors 761A to provide an indication of the velocity for the dart to be thrown. For example, the velocity can be represented by actuating the independent discrete tactor(s) 763 according to various frequencies and/or intensities (e.g., greater frequency and/or intensity being indicative of a greater velocity). In another example, the velocity can be represented by actuating the first array of tactors 761A according to a pattern (e.g., a scrolling arrow from the rear to the front of the seat portion 743 of the gaming chair 740).

In the above examples, the precursory cues are provided to enhance a skill mechanic; however, in some additional and/or alternative aspects, the precursory cues can be utilized in other contexts. For example, the controller(s) 742A-D can actuate one or more of the independent discrete tactors 763, the first array of discrete tactors 761A, and/or the second array of discrete tactors 761B to provide a precursory cue to the player indicating that there will be a transition from a first phase of a wagering game to a second phase prior to the transition.

According to additional or alternative embodiments of the present disclosure, the controller(s) can actuate one or more of the arrays of tactors 761A, 761B and/or one or more of the independent tactors 763 to provide information relating to particular player selectable options for a wagering game. For example, in a poker-type wagering game, each card of a player's hand can be associated with a different player-input button 736 such that the controller(s) 742A-D can actuate the independent tactor(s) disposed in the respective player-input buttons 736 to indicate which cards to hold and which cards to discard. The controller(s) 742A-D can additionally or alternatively actuate one or more arrays of tactors according to a pattern that indicates which cards to hold and which cards to discard.

As another example, the controller(s) 742A-D can actuate the one or more arrays of tactors 761A, 761B to indicate the volatility of a player selection option (e.g., an option with high volatility can provide an opportunity to achieve a more advantageous outcome but carry a greater risk that the option will result in a less advantageous outcome than an option with low volatility). In one non-limiting implementation, the controller(s) 742A-D can actuate the tactors of an array 761A, 761B to create the tactile sensation of an arrow scrolling the left (or right) across the footrest portion 757 of the gaming terminal 710 to suggest that the player should select a player selection option on the left (or right) side of the display of a gaming terminal 710. In yet another example, the controller (s) 742A-D can actuate an independent discrete tactor 763 disposed within a button 736 according to various frequencies and/or intensities to provide an indication of volatility (i.e., greater frequency and/or intensity being indicative of greater volatility) of a player selectable option associated with the button 736.

In some additional or alternative embodiments of the present disclosure, the controller(s) 742A-D can actuate one or more of the independent tactors 763 and/or one or more of the arrays of tactors 761A, 761B to provide an indication of the state of a spin in a reel-based wagering game. When a spin is first initiated, generally a large number of potential game outcomes (e.g., symbol combinations, bonus triggering symbols, etc.) are possible for that spin. As each reel comes to a stop, the potential game outcomes that can be achieved during the spin are reduced to the potential game outcomes that include the symbols of the stopped reels and any potential symbols that may appear on the reels that are still spinning. Accordingly, as each reel comes to a stop, the controller(s) 742A-D can actuate one or more of the independent tactors 763 and/or the arrays of tactors 761A, 761B according to various frequencies and/or intensities to indicate potential winning combinations or other game events that may be achieved when the remaining reels come to a stop. For example, the frequency and/or the intensity of the tactile stimulations can be progressively increased with each advantageous symbol (e.g., a wild symbol, a bonus trigger symbol, a symbol towards a winning combination, etc.) that appears on a stopped reel. Similarly, for example, when a disadvantageous symbol (e.g., a symbol that precludes a potential winning combination) appears on a stopped reel, the frequency and/or the intensity of the tactile stimulations can be decreased.

The controller(s) 742A-D can also actuate one or more of the independent tactors 763 and/or the arrays of tactors 742A-D to indicate that state of an anticipation spin. For example, if the appearance of two special symbols triggers an award, when one special symbol appears on one of the stopped reels, the controller(s) 742A-D can cause any remaining reek that have yet to stop to perform an anticipation spin. In an anticipation spin, the remaining reels are slowed or allowed to spin for a longer amount of time to add anticipation, excitement, and drama since the player is now aware that only one more special symbol will trigger the award. During the anticipation spin, the controller(s) 742A-D can vary the actuation of the one or more of the independent tactors 763 and/or the arrays of tactors 761A, 761B to indicate the state of the anticipation spin. For example, the frequency and/or the intensity of the tactile stimulations can progressively increase or decrease during the anticipation spin. As another example, as the spinning reel(s) slow down during an anticipation spin, the controller(s) 742A-D can actuate the one or more of the arrays of tactors 761A, 761B to simulate the sensation of a progressively increasing beating heart to enhance the sense of anticipation or drama and also indicate that the anticipation spin is coming to an end.

According to some additional or alternative embodiments of the present disclosure, the controller(s) 742A-D can actuate one or more of the independent tactors 763 and/or one or more of the arrays of tactors 761A, 761B to provide a tactile sensation that enhances a competitive wagering gaming environment. For example, the one or more independent tactors 763 and/or the one or more of the arrays of tactors 761A, 761B can be actuated by the controller(s) 742A-D to provide an indication of a player's standing or score relative to other players in the competitive environment. In one implementation, the controller(s) 742A-D can cause the tactile stimulations to increase in frequency and/or intensity as a player moves up a leader board and/or decrease in frequency and/or intensity as a player moves down a leader board.

According to some additional or alternative embodiments of the present disclosure, the controller(s) 742A-D can actuate one or more of the arrays of tactors 761A, 761B and/or one or more of the independent tactors 763 to aid visually impaired and/or the hearing impaired players. For example, the controller(s) 742A-D can actuate one or more of the independent tactors 763 and/or one or more of the arrays of tactors 761A, 761B according to various haptic profiles stored in the memory of the gaming system 700. The haptic profiles can include information relating to the frequency, intensity, and/or relative synchronizations for actuating the independent tactor(s) 763 and/or array(s) of tactors 761A, 761B. As such, distinct haptic profiles can be associated with different aspects of a wagering game such that the controller (s) actuate the independent tactor(s) 763 and/or the array(s) of tactors 761A, 761B according to a haptic profile associated with an aspect of the wagering game before, during, or after the occurrence of the aspect of the wagering game. By learning to recognize the haptic profiles, a player can receive information about the wagering game through tactile stimulations. As one non-limiting example, the controller(s) 742A-D can actuate the tactor(s) according to a first haptic profile to indicate one credit being wagered, a second haptic profile to indicate two credits being wagered, and so on.

It is contemplated that in some aspects of the above-described embodiments and examples, the haptic effects and tactile stimulations can be provided to a player independently of any audio or visual aspect of a wagering game. Accordingly, the haptic effects and tactile stimulations can be provided in addition to or in alternative to audio and visual aspects of a wagering game.

As demonstrated by these examples, the controller(s) 742A-D can be configured to actuate the independent discrete tactors 763 and/or the arrays of discrete tactors 761A, 761B to achieve a variety of haptic effects and tactile stimulations in connection with aspects of a wagering game. The above described embodiments and examples also further demonstrate how arrays of tactors 761A, 761B provide the capability to provide haptic effects and tactile stimulations that cannot be achieved with only independent discrete tactors 763. While an independent discrete tactor can be actuated according to various intensities and/or frequencies to provide various tactile profiles, the arrays of tactors can do the same and also provide a spatial aspect to the tactile profiles that cannot be achieved with only independent discrete tactors. As such, it should be appreciated that an array of tactors can function as an independent tactor in the embodiments and examples described above but an independent tactor may not function as an array of tactors.

As described above, aspects of the present disclosure involve the utilization of independent tactors and/or arrays of tactors to provide a means for exchanging information that replaces or supplements auditory and visual forms of communication with the player of a wagering game. In additional or alternative aspects of the present disclosure, a gaming chair, a gaming terminal, or a gaming system can include one or more thermal-effect devices and/or one or more arrays of thermal-effect devices, which may be actuated based on aspects of a wagering game. As such, the thermal-effect gaming chairs, gaming terminals, and gaming systems of the present disclosure can achieve distinctively advantageous wagering game-related functionalities that may not be achieved by gaming systems merely including climate control features.

Figure 12:
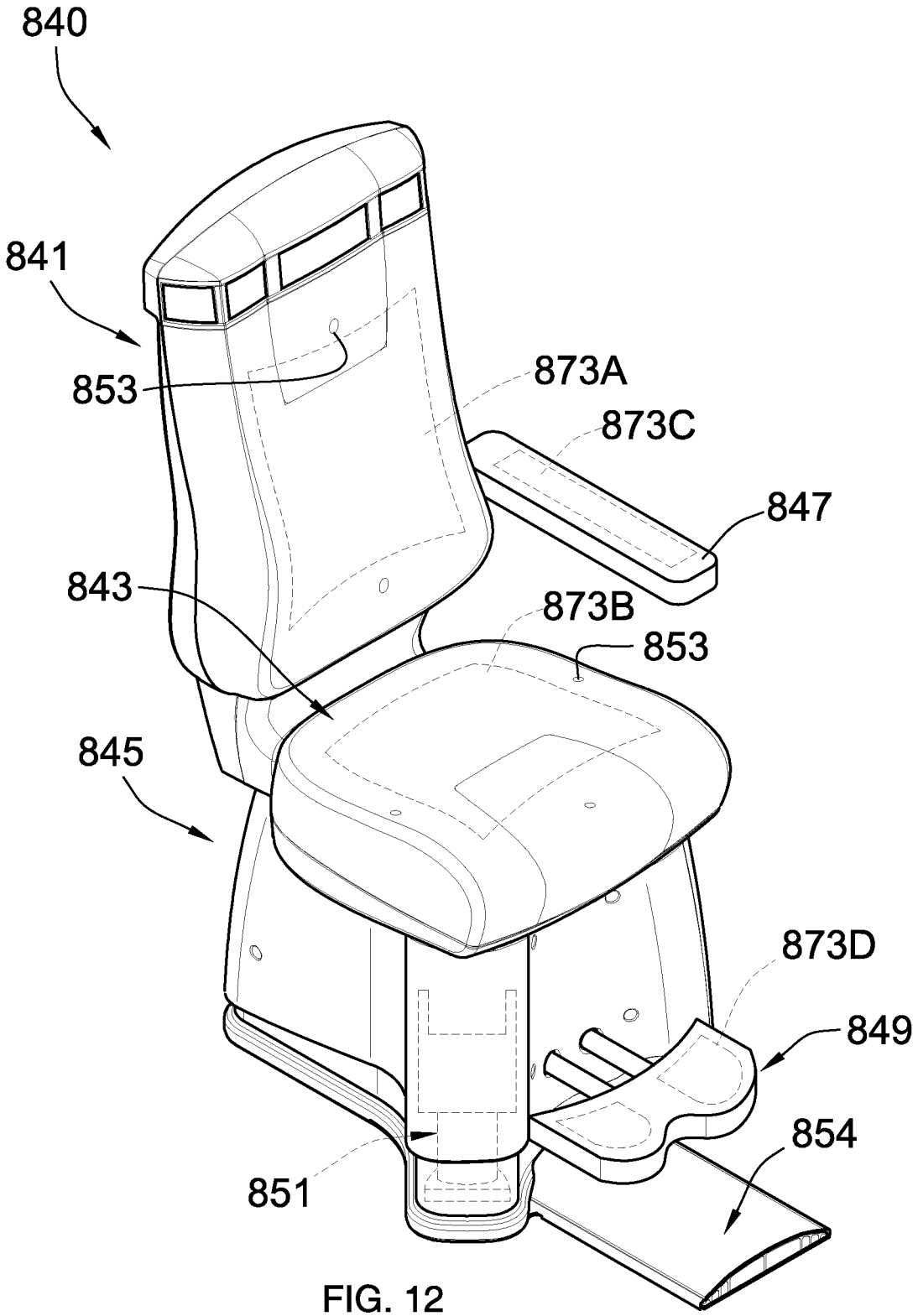
FIG. 12 is a front perspective-view illustration of an exemplary thermal-effect gaming chair in accordance with aspects of the present disclosure.

Turning to FIG. 12, wherein similar reference numerals refer to similar components from the other figures, a front perspective-view illustration of an exemplary thermal-effect gaming chair 840 is shown in accordance with aspects of the present disclosure. Similar to the gaming chair 40 of FIG. 1 and the gaming chair 140 of FIG. 5, the thermal-effect gaming chair 840 (which is likewise referred to herein as "gaming machine chair" or simply "gaming chair") generally includes a backrest assembly 841 (or "seatback" or "backrest portion") and a seat assembly 844 (or "seat bottom" or "seat portion"), both of which are functionally supported on a platform assembly (or "base") 845. An armrest 847 can be pivotally mounted to the side of the backrest assembly 841. Projecting from a lower, forward portion of the exemplary platform assembly 845 is an adjustable footrest 849. The thermal-effect gaming chair 840 can be configured to be functionally and operationally similar to the gaming chair 40 of FIG. 1 and the haptic gaming chair 140 of FIG. 5 and, thus, can include any of the features described above (e.g., a DC motor with ball screws 851, a sensing device 853, a sled 854, etc.). Consequently, for brevity and conciseness, these components will not be described again in detail.

The thermal-effect gaming chair 840 of FIG. 12 includes one or more thermal devices that are at least partially disposed in, on, and/or near a portion or selected portions of the thermal-effect gaming chair 840. As used herein, the term "thermal device" can be defined to refer to any device or devices (e.g., an actuator, a transducer, or other similar devices) configured to provide a thermal effect (e.g., a cooling effect and/or a heating effect) and thereby provoke player stimulation through thermoception.

In the embodiment illustrated in FIG. 12, the thermal-effect gaming chair 840 includes a first thermal device 873A, a second thermal device 873B, a third thermal device 873C, and a fourth thermal device 873D. The first thermal device 873A is disposed within the backrest portion 841 of the thermal-effect gaming chair 840, the second thermal device 873B is disposed within the seat portion 843 of the thermal-effect gaming chair 840, the third thermal device 873C is disposed within the pivotable armrest 847, and the fourth thermal device 873D is at least partially disposed in the footrest 849. It is contemplated that the thermal devices 873A-D of the thermal-effect gaming chair 840 can be varied from what is shown in the drawings, for example, to comprise different kinds of thermal devices, different locations, different geometries, different sizes, and/or a different number of thermal devices. Indeed, the thermal devices 873A-D can have any configuration or any position in, on, or near the gaming chair 840 permitting the player to sense a thermal effect produced by the thermal device 873A-D.

As described above, each of the thermal devices 873A-D are configured to produce a thermal effect (i.e., a heating effect and/or a cooling effect). As described further below, the thermal devices 873A-D can be actuated to produce a thermal effect according to an aspect of wagering game. The thermal devices 873A-D can be used, as described further below, to provide a means of exchanging information that replaces or supplements auditory and visual forms of communication. Moreover, the thermal devices 873A-D can be utilized to provide sensory enhancement (e.g., to simulate sensations that are part of the gaming experience), and to add a thermal dimension to light shows, video arrangements, and audio arrangements. The thermal devices 873A-D can provide a means for silent, generally invisible communication, especially in circumstances where audio and visual cues may be overlooked. For example, cues can be sent to players in situations where the audio and/or visual output is time delayed or in environments where hearing and/or seeing is difficult. Additionally, for example, the thermal devices 873A-D can facilitate skill mechanics and/or provide a precursory indication or cue relating to an upcoming event that has not yet occurred.

The thermal devices 873A-D can include any suitable features for generating a thermal effect (i.e., a heating effect and/or a cooling effect) and delivering the thermal effect to the player. As non-limiting examples, the thermal devices can include one or more resistive heaters, vortex tubes, thermoelectric devices, thermochemical devices, combinations thereof, and/or the like to generate a thermal effect. Resistive heaters generate a heating effect according to the principle of ohmic heating (i.e., an electrical current passing through a conductor generates heat). Vortex tubes are mechanical devices that separate a compressed gas into a hot gas stream and a cold gas stream. Thermoelectric devices convert an electric potential into a temperature differential by transferring heat energy from a cold side of the device to a hot side of the device to provide a heating effect and a cooling effect. Thermoelectric devices are also referred to as Peltier devices, Peltier heater pumps, solid state refrigerators, thermoelectric generators, and thermoelectric coolers. Thermochemical devices utilize a chemical reaction to generate a heating effect and a cooling effect. It is contemplated that the thermal device can derive a thermal effect from heat generated by other internal components of the wagering game system such as, for example, the power supply, the display, and/or the controller(s) of the gaming terminal or the gaming chair. Additionally, it is contemplated that, in some instances, it may be advantageous to provide a plurality of thermal device types in combination. For example, because a Peltier device produces a temperature differential, it may be advantageous to provide an additional thermal device near the hot side or the cold side of the Peltier device to provide greater control over the thermal effects produced by the Peltier device. It is contemplated that, according to some aspects, the thermal devices can be configured produce a thermal effect in a range from about 45 degrees Fahrenheit to about 105 degrees Fahrenheit. It is further contemplated that, according to some aspects, the thermal devices can be configured to have response times for achieving such thermal effects ranging from microseconds to seconds.

The thermal effect can be delivered to the player in a number ways including, but not limited to, conduction (i.e., via direct contact with the player or via indirect contact with the player such as, for example, through an interposing layer of material of the gaming chair 840 or the gaming terminal 810), convection (e.g., via airflow or liquids), and/or radiation. In thermal devices 873A-D utilizing airflow to deliver a thermal effect to a player, the airflow can be controlled and/or assisted by one or more fans, one or more pressurized air valves, other air flow control devices, or features utilizing aerodynamic principles such as, for example, the stack effect or the Venturi effect. Additionally, if airflow is utilized to deliver a thermal effect to the player, the gaming chair 840 and/or the gaming terminal 810 can include one or more apertures and/or vents configured to direct a stream of air heated or cooled by the thermal device 873A-D to the player. In some instances, the thermal device 873A-D can include one or more heat sinks to further enhance the transmission of the thermal effect to the player by increasing the surface area for exchange of thermal energy. The one or more heat sinks can also include one or more fins or other suitable features (e.g., comb structures) for further increasing the surface area of the thermal device.

The gaming chair 840 optionally can include one or more thermal sensors (not shown) for detecting an ambient temperature or a thermal effect at one or more positions in, on, or near the gaming chair 840. According to some aspects, the thermal sensors can be communicatively coupled (e.g., via wired or wireless connectivity features) to the controller(s) of a gaming system (e.g., the controller 42 of FIG. 2) to provide a signal that is indicative of the temperature detected by the thermal sensor. The one or more controller(s) can utilize such signals as feedback to adjust further actuation of the thermal devices and precisely control the thermal effect generated by the thermal device(s). Accordingly, it may be advantageous to locate one or more of the thermal sensors near a thermal device and/or near a location on the gaming chair 840 where the thermal effect is delivered to the player.

Figure 13:
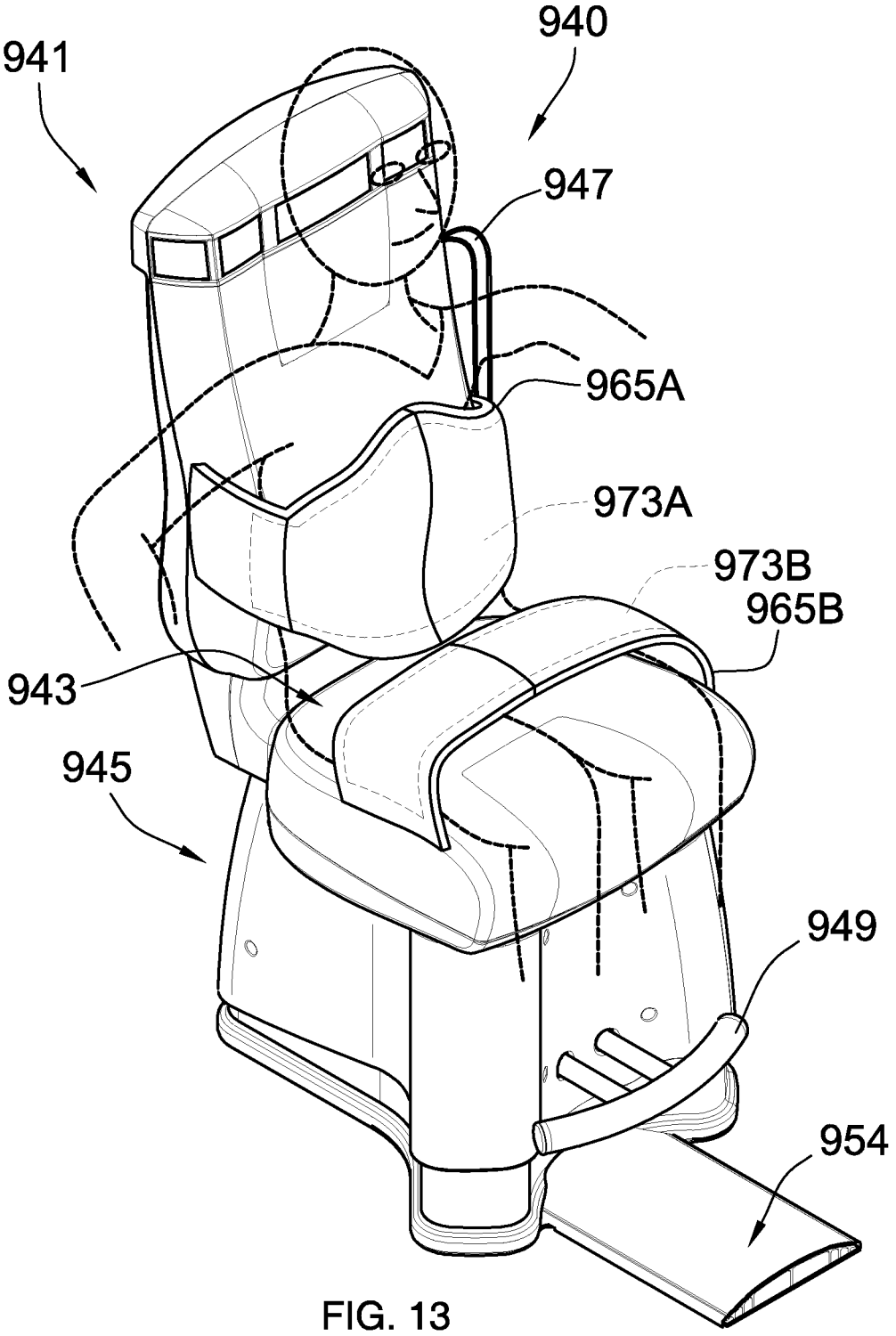
FIG. 13 is a front perspective-view illustration of another exemplary thermal-effect gaming chair in accordance with aspects of the present disclosure.

It is further contemplated that the gaming chair 840 optionally can include one or more "thermal aprons." As used herein, a "thermal apron" is a shroud that covers a portion of the player's body and includes one or more thermal devices such as, for example, the various types of thermal devices described above. Accordingly, a thermal apron is substantially similar to the haptic apron (e.g., the haptic vest 265A and the haptic leg strap 265B) described above with respect to FIG. 6, except a thermal apron includes one or more thermal devices instead of one or more tactors. For example, an exemplary gaming chair 940 (which includes a backrest 941, a seat 943, a base 945, an armrest 947, a footrest 949, and a sled 954) is illustrated in FIG. 13 having a thermal vest 965A including a first thermal device 973A and a thermal leg strap including a second thermal device 973B. As such, a thermal apron can include any of the features or configurations described above with respect to the haptic aprons. Consequently, for brevity and conciseness, these features and configurations will not be described again in detail.

Figures 14, 14A:
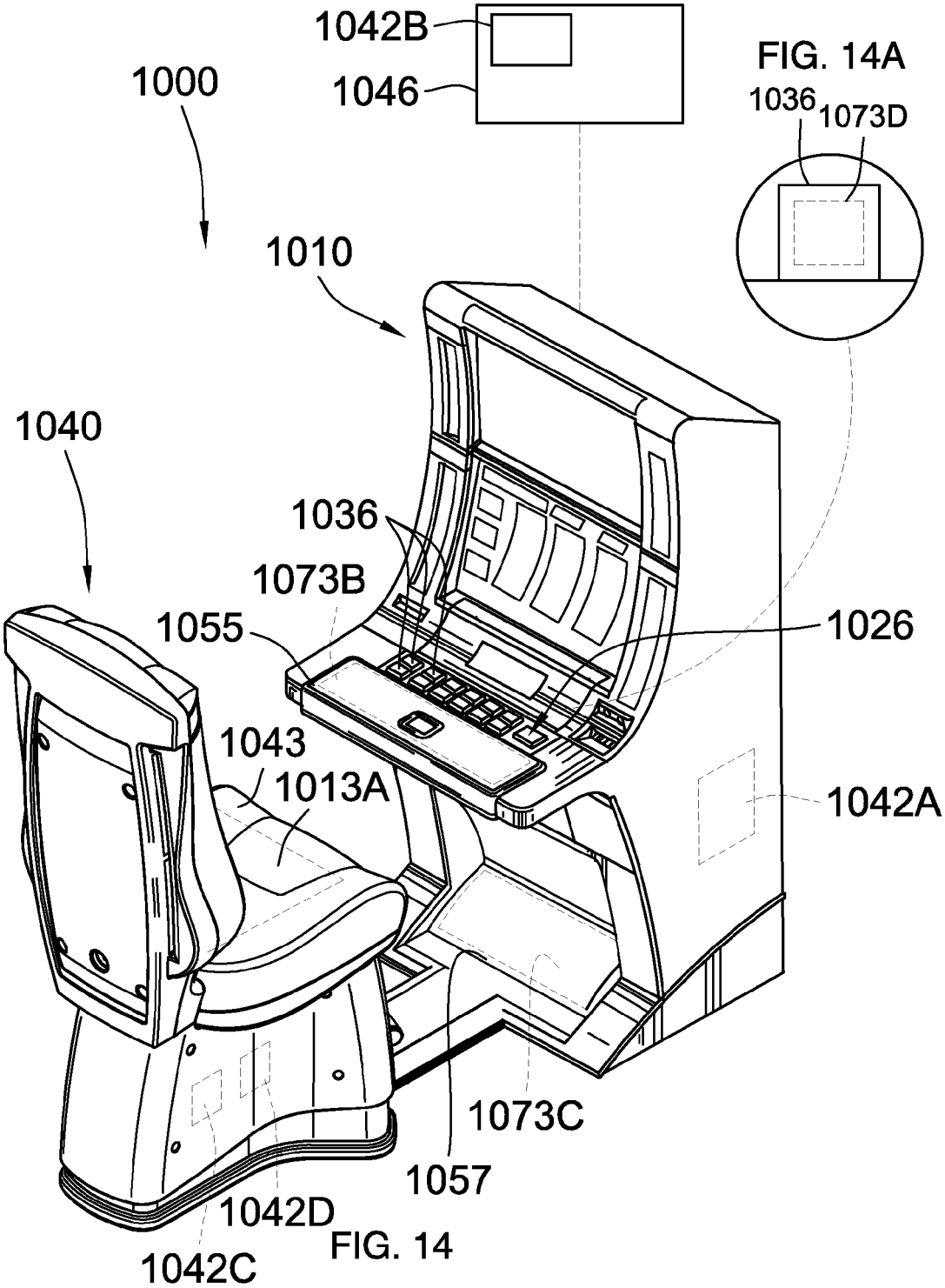
FIG. 14 is a perspective-view illustration of an exemplary gaming system with a thermal-effect gaming chair in accordance with aspects of the present disclosure.
FIG. 14A is an enlarged schematic illustration of a thermal device disposed within the exemplary gaming terminal of FIG. 14.

FIG. 14 illustrates a perspective view of an exemplary gaming system 1000 that includes a plurality of thermal devices. The gaming system 1000 includes a gaming chair 1040 and a gaming terminal 1010 that are similar in function, operation, and connectivity to the gaming chairs and gaming terminals described above. Accordingly, the gaming terminal 1010 can include any of the features illustrated and described above in connection with the gaming terminal 10 of FIGS. 1-2, the gaming terminal 310 of FIG. 7, and/or the gaming terminal 710 of FIG. 11. Similarly, the gaming chair 1040 can include any of the features illustrated and described above in connection with the gaming chair 40 of FIG. 1, the gaming chair 140 of FIG. 5, the gaming chair 240 of FIG. 6, the gaming chair 340 of FIG. 7, the gaming chair 740 of FIG. 11, the gaming chair 840 of FIG. 12, and/or the gaming chair 940 of FIG. 13. Consequently, for brevity and conciseness, these components will not be described again in detail.

The gaming system 1000 includes a first thermal device 1073A disposed in a seat portion 1043 of the gaming chair 1040, a second thermal 1073B device disposed in a footrest portion 1057 of the gaming terminal 1010, a third thermal device 1073C disposed in a wrist portion 1055 of the gaming terminal 1010, and a fourth thermal device 1073D (shown in FIG. 14A) disposed in a player-input device 1036. The first thermal device 1073A, the second thermal device 1073B, the third thermal device 1073C, and the fourth thermal device 1073D can include any of the types of thermal devices described above. Additionally, it is contemplated that the thermal devices 1073 can be varied from what is shown in the drawings, for example, to comprise different kinds of thermal devices, different locations, different geometries, different sizes, and/or a different number of thermal devices. Indeed, the thermal devices can have any configuration or any position in, on, or near the gaming chair 1040 and/or the gaming terminal 1010 permitting the player to sense a thermal effect produced by one or more of the thermal device(s) 1073A-D.

The gaming system 1000 further includes one or more controllers 1042A-D for operating the gaming system 1000. In particular, the one or more controllers 1042A-D are communicatively coupled to the first thermal device 1073A, the second thermal device 1073B, the third thermal device 1073C, and the fourth thermal device 1073D. The one or more controller(s) 1042A-D can be configured to provide signals to actuate the first thermal device 1073A, the second thermal device 1073B, the third thermal device 1073C, and the fourth thermal device 1073D to achieve various aspects of the wagering games.

According to some embodiments of the present disclosure, one or more of the controller(s) 1042A-D can actuate one or more of the thermal devices 1073A-D to provide an indication of a player's recent gameplay history. For example, the controller(s) 1042A-D can actuate the thermal device(s) 1073A-D to provide a heating thermal effect or a cooling thermal effect to the player in response to the player achieving a winning game outcome or a non-winning game outcome, respectively, of the wagering game. As the player continues to achieve winning outcomes or non-winning outcomes (either consecutively or generally over a period of time), the controller(s) 1042A-D can actuate the thermal device(s) 1073A-D to progressively increase or decrease the magnitude or frequency of the thermal effect provided to the player. Accordingly, based on a particular player's gameplay, the thermal device(s) 1073A-D can be actuated to provide an indication of whether the player is on a "hot streak" or a "cold streak", or whether the player is considered a "hot player" or a "cold player." It is contemplated that, in some instances, a player tracking system can be utilized to distinguish amongst players on a particular gaming terminal 1010.

According to additional or alternative embodiments, one or more of the controller(s) 1042A-D can actuate one or more of the thermal devices 1073A-D to provide an indication of a recent gameplay history on a particular gaming terminal 1010 without regard to the identity of the player(s) playing the gaming terminal 1010. Accordingly, the controller(s) 1042A-D can actuate the thermal device(s) 1073A-D to provide an indication of a "hot machine" or a "cold machine" based on recent gameplay on the wagering game system. It is contemplated that in some instances the controller(s) can actuate the thermal device(s) 1073A-D to provide a thermal effect even if no player is currently playing the wagering game system. As such, players may be drawn to or encouraged to play a gaming system based on a sensed thermal effect produced by one or more of the thermal devices 1073A-D of the gaming system. It is also contemplated that the gaming system can be linked with other similar gaming systems to form a bank of gaming systems such that the thermal device (s) 1073A-D in the bank can be actuated to provide an indication of a "hot bank" or a "cold bank" based on recent gameplay history on the bank of gaming terminals 1010.

According to additional or alternative embodiments, one or more of the controllers 1042A-D can actuate one or more of the thermal devices 1073A-D to coincide with a background graphic, animation, and/or video clip being displayed on a display device. For example, the controller(s) 1042A-D can actuate the thermal device(s) 1073A-D to provide a heating thermal effect to the player while a background graphic of an erupting volcano is concurrently displayed on the display and a cooling thermal effect to the player while a background graphic of a snow field is concurrently displayed on the display. In another example, the controller(s) 1042A-D can actuate the thermal device(s) 1073A-D to provide a heating thermal effect to the player when a background animation of a cannon firing is displayed and a cooling thermal effect when a background animation of a ship sinking is displayed for a pirate ship themed wagering game. Accordingly, the controller(s) 1042A-D can be configured to provide thermal effects to the player that provide a thermal context that corresponds to a scene, a theme, a level, and/or a game mode of the wagering game.

In some instances, the background graphics displayed for a wagering game can change as a player plays the wagering game. For example, the background graphics may change when the wagering game transitions from a base game to a bonus game or when the wagering game transitions from a first type of base game to a second type of base game, after a predetermined number of spins, and/or the occurrence of some other wagering game event. In instances where the background graphics gradually change from a first background graphic to a second background graphic, the controller(s) 1042A-D can actuate the thermal device(s) 1073A-D to correspondingly gradually change the thermal effect provided to the player. For example, where background graphics of a wagering game gradually change from a winter season to a spring season, the controller(s) 1042A-D can actuate the thermal device(s) 1073A-D to gradually change from a cooling thermal effect to a heating thermal effect. The above examples illustrate how the controller(s) 1042A-D and thermal device(s) 1073A-D can be configured to provide thermal effects to a player that correspond contextually to the graphics, animations, and/or video clips displayed on the display, provide sensory enhancement, and add a thermal dimension to the wagering game experience.

According to additional or alternative embodiments, one or more of the controller(s) 1042A-D can actuate one or more of the thermal device(s) 1073A-D in response to a randomly generated outcome of a wagering game including a particular symbol. For example, in response to a randomly generated outcome of a wagering game including a symbol depicting an image associated with heat or warmth (e.g., a cannon, a volcano, a flame, a palm tree, a sun, a desert, a BBQ grill, a stick of dynamite, etc.), the controller(s) 1042A-D can actuate the thermal device(s) 1073A-D to provide a heating thermal effect to the player. Similarly, in response to a randomly generated outcome of the wagering game including a symbol depicting an image associated with cold or coolness (e.g., ice, snow, a refrigerator, ice cream, snow skis, a snow man, etc.), the controller(s) 1042A-D can actuate the thermal device(s) 1073A-D to provide a cooling thermal effect to the player. As another non-limiting example, the controller(s) 1042A-D can actuate the thermal device(s) 1073A-D to provide a thermal effect to a player in response to a randomly generated outcome of wagering game including a wild symbol, a free spins symbol, an award modifier symbol, a pattern enhancement symbol (i.e., a symbol including a graphical indication of a pattern that causes other symbols of the randomly generated outcome to transform into different symbol types based on the pattern), a game asset symbol (i.e., a symbol for awarding a game asset in a wagering game that awards a player after the player collects a certain number or combination of assets), a bonus game symbol (i.e., a symbol for triggering an individual, communal, and/or competitive bonus game), a symbol for triggering a progressive jackpot, a symbol for triggering an opportunity to achieve a progressive jackpot, combinations thereof, and/or the like.

It is contemplated that, in some instances, a thermal effect may only be provided in response to a particular symbol appearing along an active payline (e.g., the payline 30 of FIG. 3) while, in other instances, a thermal effect may be provided in response to a particular symbol appearing anywhere on the reels (e.g., the reels 62 of FIG. 3). It is contemplated that the controller(s) 1042A-D can be configured to actuate the thermal device(s) 1073A-D to provide the thermal effect to the player at different magnitudes and/or frequencies depending upon the particular symbol included in the randomly generated outcome (e.g., a heating effect provided in response to an award modifier symbol that doubles a base award can have lower magnitude than a heating effect provided in response to an award modifier symbol that triples a base award).

According to additional or alternative embodiments, one or more of the controller(s) 1042A-D can actuate one or more of the thermal device(s) 1073A-D in response to a randomly generated outcome of a wagering game including a particular combination of symbols. For example, the controller(s) 1042A-D can actuate the thermal device(s) 1073A-D to provide a thermal effect to a player in response to a randomly generated outcome including a combination of symbols associated with an award amount that is less than, equal to, or greater than a predetermined award amount. As another non-limiting example, the controller(s) 1042A-D can actuate the thermal device(s) 1073A-D to provide a thermal effect to a player in response to a randomly generated outcome including a combination of symbols that triggers a bonus game, a combination of symbols that awards one or more free spins, a combination of symbols that awards a game asset, a combination of symbols that awards a progressive jackpot, a combination of symbols that awards an opportunity to achieve a progressive jackpot, combinations thereof, and/or the like. In yet another non-limiting example, the controller(s) 1042A-D can actuate the thermal device(s) 1073A-D to provide a thermal effect in response to a combination of symbols that includes two or more of a particular symbol type (e.g., two or more of the symbols described above) regardless of the award amount associated with the combination of symbols.

Additionally, the controller(s) 1042A-D can be configured to actuate the thermal device(s) 1073A-D to provide the thermal effect to the player at varying magnitudes and/or frequencies depending upon the particular symbol combination included in a randomly generated outcome. For example, the controller(s) 1042A-D can actuate the thermal device(s) 1073A-D to provide a greater magnitude thermal effect to the player in response to a symbol combination associated with a large award amount and a lower magnitude thermal effect to the player in response to a symbol combination associated with a small award amount. As another non-limiting example, the controller(s) 1042A-D can actuate the thermal device(s) 1073A-D to provide a greater magnitude thermal effect to the player depending upon the number of symbols in a combination of symbols (e.g., providing a lower magnitude thermal effect in response to a winning combination comprising three symbols and a greater magnitude thermal effect in response to a winning combination comprising four symbols). As still another non-limiting example, the controller(s) 1042A-D can actuate the thermal device(s) 1073A-D to provide a thermal effect at a magnitude according to the number of times a particular predetermined symbol appears in a combination of symbols (e.g., providing a lower magnitude thermal effect in response to a symbol combination comprising two wild symbols and a greater magnitude thermal effect in response to a symbol combination including three wild symbols).

According to additional or alternative embodiments, one or more of the controller(s) 1042A-D can actuate one or more of the thermal device(s) 1073A-D before, during, or after a bonus game event. For example, the controller(s) 1042A-D can actuate the thermal device(s) 1073A-D to provide a thermal effect throughout the duration of the bonus game. In another non-limiting example, the controller(s) 1042A-D can actuate the thermal device(s) 1073A-D to provide a heating effect to the player to indicate the start of a bonus game and a cooling effect to the player to indicate the end of a bonus game. In yet another non-limiting example, the controller(s) 1042A-D can actuate the thermal device(s) 1073A-D to provide an indication of timing in connection with a bonus game. In some instances, the controller(s) 1042A-D can actuate the thermal device(s) 1073A-D to provide a thermal effect that gradually increases in magnitude and/or frequency as the time remaining before the start of a bonus game decreases (or vice versa). In some instances, the controller(s) 1042A-D can actuate the thermal device(s) 1073A-D to provide a thermal effect that gradually increases in magnitude and/or frequency as the time remaining before the end of a bonus game decreases (or vice versa). In a non-limiting competitive type bonus game example, the controller(s) 1042A-D can actuate the thermal device(s) 1073A-D to provide a thermal effect to indicate a player's position relative to other players participating in the competitive bonus game. In another non-limiting example, the controller(s) 1042A-D can actuate the thermal device(s) 1073A-D to provide a thermal effect according to a level of activity occurring in a bonus game. In some instances, the temperature of the thermal effect can be increased or decreased as the level of activity in the bonus game increases or decreases.

According to additional or alternative embodiments, one or more of the controller(s) 1042A-D can actuate one or more of the thermal device(s) 1073A-D before, during, or after any other wagering game event. For example, the controller(s) 1042A-D can actuate the thermal device(s) 1073A-D in response to a player activating at least a predetermined number of paylines (or the maximum number of paylines). As another non-limiting example, the controller(s) 1042A-D can actuate the thermal device(s) 1073A-D in response to a player wagering at least a predetermined number of credits (or the maximum number of credits). In yet another non-limiting example, the controller(s) 1042A-D can actuate the thermal device(s) 1073A-D in response to a player collecting all game asserts required for achieving an award. In a further non-limiting example, the controller(s) 1042A-D can actuate the thermal device(s) 1073A-D in response to a player achieving an objective of the wagering game. In another non-limiting example, the controller(s) 1042A-D can actuate the thermal device(s) 1073A-D to provide an indication that a player is progressing towards an objective (e.g., the thermal device(s) 1073A-D provide a thermal effect of increasing magnitude as the player progresses towards an objective). In a further non-limiting example, the controller(s) 1042A-D can actuate the thermal device(s) 1073A-D to provide an indication that the rules of the wagering game have changed (e.g., the pay table has changed or a new symbol has become a wild symbol).

According to additional or alternative embodiments, one or more of the controller(s) 1042A-D can be configured to actuate one or more of the thermal device(s) 1073A-D to facilitate a skill mechanic of a wagering game. For example, the controller(s) 1042A-D can actuate the thermal device(s) 1073A-D to provide an indication of an advantageous or optimal time (or time period) for a player to actuate an input (e.g., the buttons 1036). In one exemplary implementation, the controller(s) 1042A-D can actuate the thermal device(s) 1073A-D to provide an indication of an advantageous or optimal time for the player to actuate the player-input button 1036 to stop a spinning reel. If the player stops the spinning reel at the optimal time (or time period), the odds of a certain advantageous symbol (e.g., a wild symbol) appearing in the randomly generated outcome of the wagering game may be increased. Similarly, for example, the controller(s) 1042A-D can actuate the thermal device(s) 1073A-D to provide an indication of a disadvantageous or suboptimal time (or time period) for a player to actuate an input. In some instances, the controller(s) 1042A-D can actuate the thermal device(s) 1073A-D to provide a heating thermal effect to indicate an optimal time and a cooling thermal effecting to indicate a suboptimal time for the player to actuate a player input (e.g., the button 1036). It is also contemplated that the controller(s) 1042A-D can actuate the thermal device(s) 1073A-D according to various magnitudes and/or frequencies to indicate an optimal or suboptimal time for a player to actuate a player input (e.g., the greater the magnitude of the thermal effect, the more advantageous it is for the player to actuate a player input).

According to additional or alternative embodiments, one or more of the controller(s) 1042A-D can be configured to actuate one or more of the thermal device(s) 1073A-D to provide information relating to particular player selectable options for a wagering game. For example, in a poker-type wagering game, each card of a player's poker hand can be associated with a different thermal device 1073A-D. The controller(s) 1042A-D can actuate the thermal device(s) 1073A-D to indicate which cards to hold and which cards to discard (e.g., a heating thermal effect can be provided for each card that should be held and/or a cooling thermal effect can be provided for each card that should be discarded).

As another non-limiting example, the controller(s) 1042A-D can actuate the thermal device(s) 1073A-D to provide an indication of a volatility of a player selection option (e.g., an option with high volatility provides an opportunity to achieve a more advantageous outcome but carries a greater risk that the option will result in a less advantageous outcome than an option with low volatility). In one exemplary implementation, the controller(s) 1042A-D can actuate the thermal device(s) 1073A-D to provide a heating effect to the player to indicate that a player selection option has a high volatility and/or the controller(s) 1042A-D can actuate the thermal device(s) 1073A-D to provide a cooling effect to the player to indicate that a player selection option has a low volatility. In another exemplary implementation, the controller(s) 1042A-D can actuate the thermal device(s) 1073A-D to provide a thermal effect at a temperature that corresponds to the volatility of a player selection option (e.g., a low temperature heating effect is provided for a low volatility option and a higher temperature heating effect is provided for a higher volatility option).

In a further non-limiting example, the controller(s) 1042A-D can actuate the thermal device(s) 1073A-D to provide a clue to the player with respect to an aspect of the wagering game. In one exemplary implementation, the controller(s) 1042A-D can actuate the thermal device(s) 1073A-D to provide an indication of whether the player is getting "hotter" or "colder" as the player searches for a hidden item in the wagering game. As the player gets closer to the hidden item, the controller(s) 1042A-D can actuate the thermal device(s) 1073A-D to provide a thermal effect of increasing temperature. Similarly, as the player gets farther from a hidden item, the controller(s) 1042A-D can actuate the thermal device(s) 1073A-D to provide a thermal effect of decreasing temperature.

To facilitate providing information relating to player selectable options, it is contemplated that according to some implementations, the thermal device(s) 1073A-D can be actuated in response to a player selectable option being highlighted (e.g., moving a cursor over a selectable option on the display). It is also contemplated that a thermal device 1073A-D can be disposed in one or more player inputs (e.g., the buttons 1036) such that the thermal device(s) 1073A-D disposed in a player-input button 1036 provides a thermal indication for a player selection option associated with the player-input button 1036.

According to some embodiments of the present disclosure, one or more of the controller(s) 1042A-D can be configured to actuate one or more of the thermal device(s) 1073A-D to provide an indication of the state of a spin in a reel-based wagering game. When a spin is first initiated, generally a large number of potential game outcomes (e.g., symbol combinations, bonus triggering symbols, etc.) are possible for that spin. As each reel comes to a stop, the potential game outcomes that can be achieved during the spin are reduced to the potential game outcomes that include the symbols of the stopped reels and any potential symbols that may appear on the reels that are still spinning. Accordingly, as each reel comes to a stop, the controller(s) 1042A-D can actuate the thermal device(s) 1073A-D to provide an indication of the potential winning combinations or other game events that may be achieved when the remaining reels come to a stop. For example, the magnitude of the thermal effects provided by the thermal device(s) 1073A-D can be progressively increased with each advantageous symbol (e.g., a wild symbol, a bonus trigger symbol, a symbol towards a winning combination, etc.) that appears on a stopped reel. Similarly, the magnitude of the thermal effects provided by the thermal device(s) 1073A-D can be progressively decreased with each disadvantageous symbol (e.g., a symbol that precludes a potential winning combination) that appears on a stopped reel.

The controller(s) 1042A-D can also actuate the thermal device(s) 1073A-D to indicate that state of an anticipation spin. For example, if the appearance of two special symbols triggers an award, when one special symbol appears on one of the stopped reels, the controller(s) 1042A-D can cause any remaining reels (that are still spinning) to perform an anticipation spin. In an anticipation spin, the remaining reels are slowed or allowed to spin for a longer amount of time to add anticipation, excitement, and drama since the player is now aware that only one more special symbol will trigger the award. During the anticipation spin, the controller(s) 1042A-D can actuate the thermal device(s) 1073A-D to indicate the state of the anticipation spin. For example, the magnitude of the thermal effect provided by the thermal device(s) 1073A-D can progressively increase or decrease during the anticipation spin.

Figure 15:
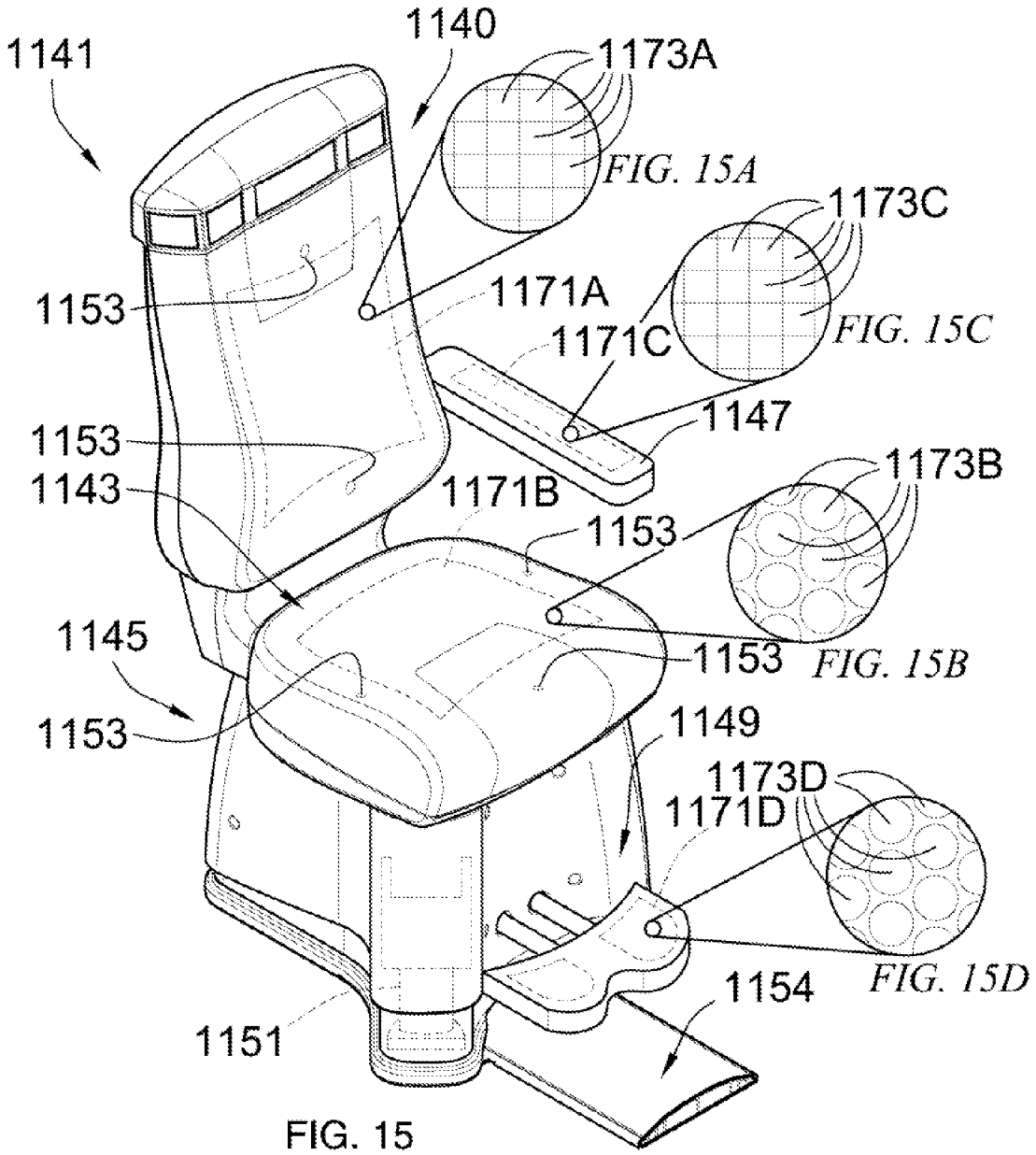
FIG. 15 is a front perspective-view illustration of an exemplary thermal-effect gaming chair in accordance with aspects of the present disclosure.

It is contemplated that, according to some embodiments, one or more of the controller(s) 1042A-D can be configured to synchronize the actuation of various thermal devices 1073A-D provided in a gaming system to provide thermal effects having a spatial aspect. For example, it is contemplated that a plurality of thermal devices 1073A-D can be provided in a gaming chair and/or a gaming terminal as an array of discrete thermal devices in a similar manner to the arrays of discrete tactors explained above with respect to FIGS. 5-11. FIG. 15 illustrates an exemplary thermal-effect gaming chair 1140 that includes a first matrix array 1171A of discrete thermal devices 1173A disposed in a backrest assembly 1141, a second matrix array 1171B of discrete thermal devices 1173B disposed in a seat assembly 1143, a third matrix array 1171C of thermal devices 1173C disposed in a pivotable armrest 1147, and a fourth matrix array 1171D of thermal devices 1173D disposed in a footrest 1149 of a thermal-effect gaming chair 1140. It should be recognized that the matrices of thermal devices 1171A-D can be varied from what is shown in FIG. 15, for example, to comprise different kinds of thermal devices, different thermal device arrangements, different matrix locations, different matrix geometries, different matrix sizes, a different number of matrices, combinations thereof, and/or the like. The thermal-effect gaming chair 1140 can be configured to be functionally and operationally similar to the haptic gaming chair 140 of FIG. 5 and/or the thermal-effect gaming chair 840 of FIG. 12 and, thus, can include any of the features described above (e.g., a DC motor with ball screws 1151, a sensing device 1153, a sled 1154, etc.).

Additionally, it is contemplated that one or more arrays of thermal devices can additionally or alternatively be provided in a thermal apron (e.g., the thermal aprons 965A, 965B of FIG. 13). Further, it is contemplated that the locations of the discrete thermal devices in an array can correspond to a respective location on a display of a gaming terminal in a similar manner to the above description with respect to FIG. 8.

The controller(s) of a gaming system (e.g., one or more of the controller(s) 1042A-D) including one or more arrays of thermal devices 1171A-D can thus be configured to synchronize actuation of the array(s) of thermal devices 1171A-D to create a thermal pattern on the player and/or a simulated movement of a thermal effect. For example, the controller(s) can actuate the thermal devices 1173A-D of the array(s) 1171A-D in a synchronized manner to create a thermal sensation of a gust of cold air across a player's body. As another non-limiting example, the controller(s) can actuate the thermal devices 1173A-D of the array(s) 1171A-D in a synchronized manner to simulate a sensation of a blast of heat passing across a player's body as an animation of a dragon breathing fire is displayed on a display device of a gaming terminal. In yet another non-limiting example, the controller(s) can actuate the thermal devices 1173A-D of the array(s) 1171A-D in a synchronized manner to simulate a sensation of heat traveling up a player's body as an animation of a person being dipped in boiling water is displayed on the gaming terminal. In a further example, the controller(s) can actuate the thermal devices 1173A-D of the array(s) 1171A-D in a synchronized manner to create a thermal pattern of a ring, a square, a triangle, an arrow, etc. on a portion of the player's body.

According to some additional or alternative embodiments of the present disclosure, the controller(s) can actuate one or more of the arrays of thermal devices and/or one or more of the independent thermal devices to aid visually impaired and/or the hearing impaired players. For example, the controller(s) can actuate one or more of the independent thermal devices and/or one or more of the arrays of thermal devices according to various thermal profiles stored in the memory of the gaming system. The thermal profiles can include information relating to the frequency, magnitude, and/or relative synchronizations for actuating the independent thermal devices and/or array(s) of thermal devices. As such, distinct thermal profiles can be associated with different aspects of a wagering game such that the controller(s) actuate the independent thermal devices and/or the array(s) of thermal devices according to a thermal profile associated with an aspect of the wagering game before, during, or after the occurrence of the aspect of the wagering game. By learning to recognize the thermal profiles, a player can receive information about the wagering game through tactile stimulations. As one non-limiting example, the controller(s) actuate the tactor (s) according to a first thermal profile to indicate one credit being wagered, a second thermal profile to indicate two credits being wagered, and so on.

It is contemplated that in some aspects of the above-described embodiments and examples, the thermal effects can be provided to a player independently of any audio or visual aspect of a wagering game. Accordingly, the thermal effects can be provided in addition to or in alternative to audio and visual aspects of a wagering game.

Figure 16:
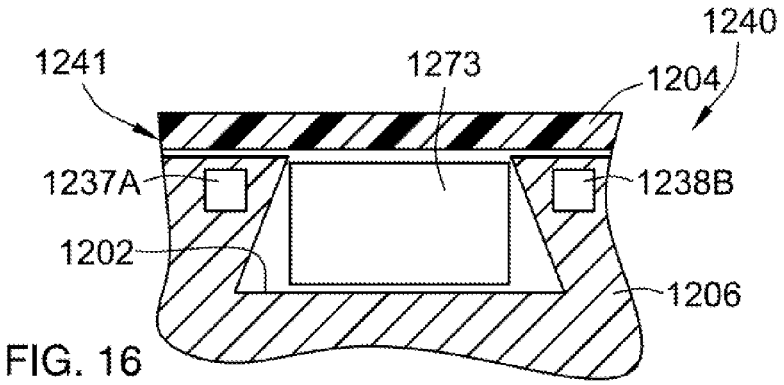
FIG. 16 is a schematic illustration of an exemplary thermal device disposed within a representative section of an exemplary thermal-effect gaming chair.

FIG. 16 is a schematic illustration of an exemplary thermal device 1273 that is disposed within a representative section, e.g., a cushion 1206 of a backrest assembly 1241 of a thermal-effect gaming chair (e.g., the gaming chair 840). The thermal device 1273 is disposed inside a cavity 1202 and covered by an elastomeric sheet 1204, through which the thermal effect generated by the thermal device 1273 can be transferred. It is contemplated that the elastomeric sheet 1204 can include one or more apertures or perforations for facilitating the transfer of thermal energy from the thermal device 1273 to the player. The thermal-effect gaming chair 1240 is also shown comprising a first lighting element 1238A and a second lighting element 1238B located in the backrest assembly 1241 on opposing sides of the thermal device 1273. The first lighting element 1238A and the second lighting element 1238B can be actuated at a frequency and intensity that coincides with the actuation of the thermal device 1273. For example, the first lighting element 1238A and the second lighting element 1238B can be actuated to produce a red light when the thermal device 1273 is actuated to produce a heating effect and a blue light when the thermal device 1273 is actuated to produce a cooling effect.

In the embodiments described above with respect to FIGS. 12-16, the gaming chairs, the gaming terminals, and the gaming systems were configured to provide a thermal effect sensed by a player through thermoception. However, according to additional or alternative embodiments, the gaming chairs, the gaming terminals, and/or the gaming systems can include features allow a player to visually sense a thermal effect. For example, the gaming chairs, the gaming terminals, and/or the gaming systems can include a thermal display device that is configured to undergo some physical change in response to a change in temperature.

Figure 17:
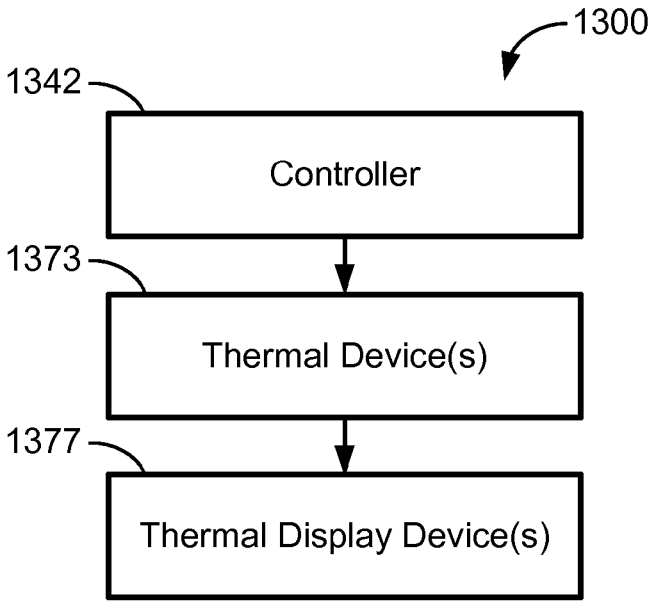
FIG. 17 is an exemplary schematic diagram of a system for visually providing a thermal effect to a player.

FIG. 17 illustrates an exemplary schematic diagram of a system (including a gaming terminal and/or a gaming chair) for providing a feature that allows a thermal effect to be visually sensed by a player. The system 1300 includes one or more controllers 1342 (e.g., any of the controllers illustrated and described above with respect to FIGS. 2, 7, 11, and 14), one or more thermal devices 1373, and one or more thermal display devices 1377. As described above, the controller(s) 1342 are configured to actuate the thermal device(s) 1373 to produce a thermal effect. The thermal device(s) 1373 are configured to provide the thermal effect to the thermal display device(s) 1377. For example, the thermal device(s) 1373 can be coupled to or located near the thermal display device(s) 1377. The thermal display device(s) 1377 are configured to be actuated in response to the thermal display device(s) 1377 receiving the thermal effect from the thermal device(s) 1373. For example, the thermal device(s) 1377 can comprise a lava lamp (i.e., a lamp including blobs of colored wax inside a glass vessel filed with a transparent liquid such that the wax rises and falls as its density changes due to heating from the thermal device(s) 1373), a liquid thermometer, a bubbler (e.g., a sealed container including a liquid that bubbles in response to a heating effect provided by the thermal device(s) 1373), a material having thermochromism characteristics (e.g., liquid crystals and/or leuco dyes), smart materials that change shape in response to temperature changes (e.g., bimetallic alloys), thermo-reactive paint or ink, combinations thereof, and/or the like.

Figure 18:
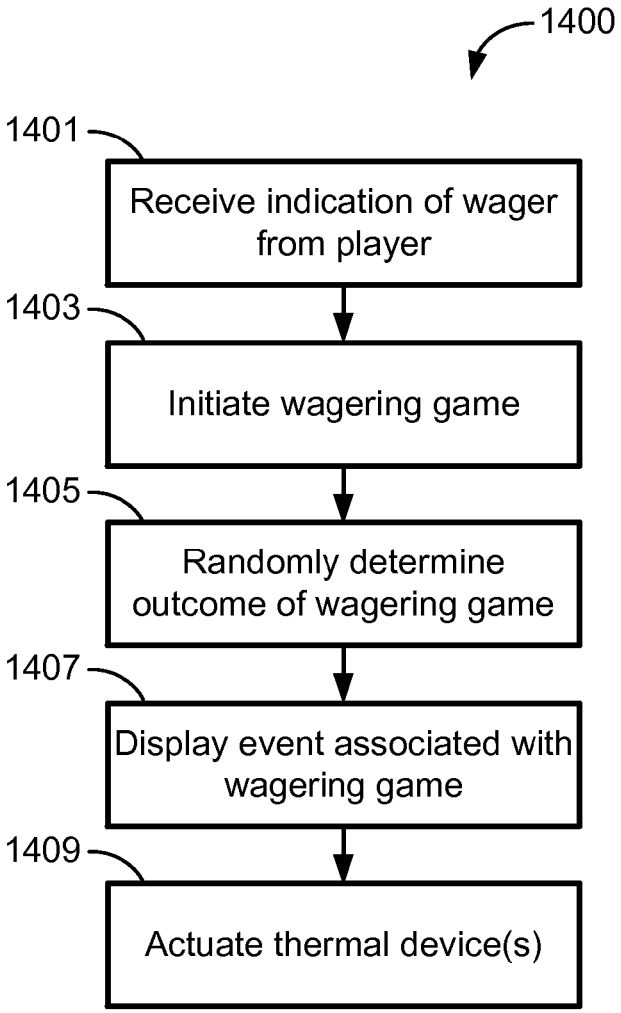
FIG. 18 is a flowchart for an algorithm that corresponds to instructions executed by a controller in accord with at least some aspects of the disclosed concepts.

Referring now to FIG. 18, a flow chart for a method of conducting a wagering game in a wagering game system is illustrated. FIG. 18 represents an algorithm 1400 that corresponds to at least some instructions that can be executed by, for example, one or more of the controllers described above to perform any or all of the above and/or below described functions associated with the disclosed concepts. The instructions corresponding to the algorithm 1400 can be stored on a non-transitory computer-readable medium, such as on a hard drive or other mass storage device or a memory device.

The exemplary algorithm 1400 of FIG. 18 includes, at block 1401, receiving an indication of a wager from a player to play the wagering game and, at block 1403, responsively initiating the wagering game. The wagering game may include those wagering games described above with respect to FIGS. 3 and 4, or any other suitable wagering game. At block 1405, the exemplary method 1400 includes determining (e.g., via controller 42 of FIG. 2) an outcome of the wagering game. The wagering-game outcome is randomly determined from a plurality of wagering-game outcomes, for example, using a random number generator (RNG) in the manner disclosed above. One or more of the plurality of wagering-game outcomes constitutes a winning outcome for which a corresponding award is conferred upon the player. In addition or as an alternative to the foregoing, block 1403 may comprise determining stop position(s) for a plurality of mechanical reels in the array.

The method 1400 also includes, at block 1407, displaying an event associated with the wagering game, e.g., via the primary display area 14 and/or secondary display area 16 of FIG. 1. This event may include the outcome of the wagering game, as determined at block 1405. Alternatively, this event may be independent of the outcome of the wagering game and, in some embodiments, altogether unrelated to the wagering game. At block 1409, one or more thermal devices are actuated to provide a thermal effect to the player in connection with an aspect of the wagering game.

In some embodiments, the method 1400 includes at least those steps enumerated above. It is also within the scope and spirit of the present invention to omit steps, include additional steps, and/or modify the order presented above. It should be further noted that the method 1400 represents a single play of a wagering game. However, it is expected that the method 1400 can be applied in a systematic and repetitive manner.

The disclosed concepts can be employed with free-standing gaming terminals (upright and slant top), countertop gaming machines, handheld gaming devices, etc. To that end, the disclosed concepts can be employed in solitary gaming, network gaming, community gaming, and bank gaming.

It is contemplated that any of the features and functionalities of the embodiments illustrated in the drawings and described above can be combined. For example, it is contemplated that a gaming chair, a gaming terminal, and/or a gaming system can include one or more independent tactors, one or more independent thermal devices, one or more arrays of tactors, and/or one or more arrays of thermal devices.

According to further aspects of the present disclosure, an improved auditory feature can be provided. The auditory feature can include a narrative description of the aspects of a wagering game before, during, or after the occurrence of those aspects of the wagering game. In particular, the narrative description can include a detailed, running commentary and auditory description of a wagering game in real time. For example, a narrative description can include details about how the reels are spinning, details about how the reels slow down, details about the appearance of particularly advantageous symbols as the reels come to stop, and details about what the player won or lost. The detailed explanation of the real time events of a wagering game can appeal to a player's imagination and provoke a heightened level of excitement. This is in contrast to an audio presentation that merely indicates that a play of a wagering game was initiated and then indicates the result without providing a detailed narrative about how the result was achieved. In addition to adding excitement to a wagering game, a narrative description can assist those that may be visually impaired in playing a wagering game. It is contemplated that a player may be able to access the narrative description via a separate audio output provided on a gaming system.

While many preferred embodiments and best modes for carrying out the present disclosure have been described in detail above, those familiar with the art to which this disclosure relates will recognize various alternative designs and embodiments for practicing the invention within the scope of the appended claims.

The invention claimed is:

1. A gaming system primarily dedicated to conducting a wagering game, the gaming system comprising:

at least one gaming cabinet configured to house electronic components operable for conducting the wagering game;

at least one electronic input device coupled to the at least one gaming cabinet and configured to receive a physical input from a player as an indication of a wager, and further configured to transform the physical input into an electronic data signal;

at least one electronic display device coupled to the at least one gaming cabinet and configured to display a plurality of player-selectable options for the wagering game;

at least one electronic random element generator configured to generate random elements associated with randomly determined outcomes of the wagering game;

at least one gaming chair adjacent the at least one gaming cabinet;

a plurality of discrete thermal devices coupled to the at least one gaming cabinet or the at least one gaming chair, or both, the discrete thermal devices being configured to produce a thermal effect;

at least one controller in operative communication with the discrete thermal devices; and at least one memory device storing instructions that, when executed by the at least one controller, cause each of the discrete thermal devices to produce a distinct thermal effect that provides an indication of a volatility for each of the plurality of player-selectable options of the wagering game.

2. The gaming system of claim 1, wherein the at least one gaming cabinet includes a button panel with a plurality of player-input buttons, the one or more of the discrete thermal devices being disposed in the player-input buttons of the gaming cabinet.

3. The gaming system of claim 1, wherein one or more of the discrete thermal devices are disposed in a backrest portion of the at least one gaming chair.

4. The gaming system of claim 1, wherein the at least one controller is configured to synchronize actuation of the discrete thermal devices to thereby create a sensation of a thermal pattern.

5. The gaming system of claim 1, wherein one or more of the discrete thermal devices comprise one or more thermoelectric devices.

6. The gaming system of claim 1, further comprising at least one thermal sensor in operative communication with the at least one controller to form a thermal feedback system, the thermal feedback system including the at least one thermal sensor, the at least one controller, and one or more of the discrete thermal devices, the at least one controller being configured to adjust the thermal effects produced by the one or more of the discrete thermal devices based on one or more signals received by the at least one controller from the at least one thermal sensor.

7. The gaming system of claim 1, further comprising a thermal display device configured to undergo a physical change in response to the thermal effect produced by the one or more thermal devices.

8. The gaming system of claim 1, further comprising at least one player input button coupled to the at least one gaming cabinet, at least one of the discrete thermal devices being disposed in the at least one player input button such that the player can physically touch the at least one discrete thermal device.

9. A gaming chair for a wagering game system configured to conduct a wagering game, the gaming chair comprising:

a seat portion;

a backrest portion;

a base connected to and supporting the seat portion and the backrest portion;

a plurality of discrete thermal devices coupled to the seat portion or the backrest portion, or both, and configured to produce a thermal effect;

at least one controller in operative communication with the thermal devices, the at least one controller being configured to actuate the thermal devices in response to randomly determined events occurring in the wagering game; and at least one thermal sensor in operative communication with the at least one controller to form a thermal feedback system, the at least one controller being configured to adjust the thermal effect produced by the thermal devices based on one or more signals received by the at least one controller from the at least one thermal sensor.

10. The gaming chair of claim 9, wherein the at least one of the thermal devices is disposed within, an armrest portion or a thermal apron portion of the gaming chair.

11. The gaming system of claim 9, wherein the plurality of discrete thermal devices comprises an array of thermal devices, and the at least one controller is further configured to synchronize actuation of the array of thermal devices to thereby create at least one of a sensation of a thermal pattern and a simulated movement of a thermal effect.

12. The gaming chair of claim 9, wherein the at least one thermal sensor is configured to measure an ambient temperature.

13. The gaming chair of claim 9, wherein the at least one thermal sensor is located near at least one of the discrete thermal devices.

14. A method of conducting a wagering game on a wagering game system primarily dedicated to conducting casino wagering games, the method comprising:

receiving, via at least one electronic input device, a physical input from a player as an indication of a wager to initiate the wagering game;

initiating the wagering game, via at least one processor, in response to an electronic data signal generated by the at least one electronic input device responsive to the physical input from the player;

randomly determining, via the at least one processor and based, at least in part, on a random element generated by at least one electronic random element generator, an outcome of the wagering game from a plurality of wagering-game outcomes;

displaying, via at least one electronic display device, the randomly determined outcome of the wagering game; and synchronously actuating a plurality of discrete thermal devices coupled to at least one gaming cabinet or at least one gaming chair, or both, to produce a thermal effect that provides a precursory cue facilitating a skill mechanic of the player during a skill-based feature of the wagering game.

15. The method of claim 14, wherein the thermal effect facilitates the skill mechanic by indicating an optimal time for actuating an input.

16. The method of claim 15, wherein a likelihood of an advantageous symbol appearing in a randomly selected outcome of the wagering game is increased if the input is actuated during the optimal time.

17. The method of claim 15, wherein the thermal effect further facilitates the skill mechanic by indicating a suboptimal time for actuating the input.

18. A gaming system primarily dedicated to conducting a wagering game, the gaming system comprising:

at least one gaming cabinet configured to house electronic components operable for conducting the wagering game;

at least one electronic input device coupled to the at least one gaming cabinet and configured to receive a physical input from a player as an indication of a wager, and further configured to transform the physical input into an electronic data signal;

at least one electronic display device coupled to the at least one gaming cabinet and configured to display randomly determined outcomes of the wagering game;

at least one gaming chair adjacent the at least one gaming cabinet;

a plurality of discrete thermal devices coupled to the at least one gaming cabinet or the at least one gaming chair, or both, the discrete thermal devices being configured to produce a thermal effect;

at least one controller in operative communication with the discrete thermal devices; and at least one memory device storing instructions that, when executed by the at least one controller, cause each of the discrete thermal devices to produce a distinct thermal effect that at least one of (i) provides a precursory cue facilitating a skill mechanic of the player during a skill-based feature of the wagering game, or (ii) indicates a volatility for each of a plurality of player selectable options of the wagering game.

19. The gaming system of claim 18, wherein the thermal effect facilitates the skill mechanic by indicating an optimal time for actuating an input.

20. The gaming system of claim 19, wherein the input is at least one player input button, one or more of the discrete thermal devices being disposed in the at least one player input button.

21. The gaming system of claim 18, wherein one or more of the discrete thermal devices comprise one or more thermoelectric devices.

22. A method of conducting a casino wagering game on a wagering game system primarily dedicated to conducting casino wagering games, the method comprising:

receiving, via at least one electronic input device, a physical input from a player as an indication of a wager to initiate the casino wagering game;

initiating the casino wagering game, via at least one processor, in response to an electronic data signal generated by the at least one electronic input device responsive to the physical input from the player;

randomly determining, via the at least one processor and based, at least in part, on a random element generated by at least one electronic random element generator, an outcome of the wagering game from a plurality of wagering-game outcomes;

displaying, via at least one electronic display device, the randomly determined outcome of the wagering game; and synchronously actuating a plurality of discrete thermal devices coupled to at least one gaming cabinet or at least one gaming chair, or both, to produce a plurality of thermal effects that each indicates a volatility for one of a plurality of player selectable options of the wagering game.

23. The method of claim 22, wherein the indication of the state of the one or more spinning reels of the wagering game is an indication of one or more potential winning outcomes or game events that can be achieved when all of the one or more spinning reels stop.

24. The method of claim 22, wherein the indication of the state of the one or more spinning reels is an indication of an anticipation spin.

25. A gaming system primarily dedicated to conducting a wagering game, the gaming system comprising:

at least one gaming cabinet configured to house electronic components operable for conducting the wagering game;

at least one electronic input device coupled to the at least one gaming cabinet and configured to receive a physical input from a player as an indication of a wager, and further configured to transform the physical input into an electronic data signal;

at least one electronic display device coupled to the at least one gaming cabinet and configured to display a plurality of player-selectable options for the wagering game;

at least one gaming chair adjacent the at least one gaming cabinet;

a plurality of discrete thermal devices coupled to the at least one gaming cabinet or the at least one gaming chair, or both, the discrete thermal devices being configured to produce a thermal effect;

at least one controller in operative communication with the discrete thermal devices; and at least one memory device storing instructions that, when executed by the at least one controller, cause each of the discrete thermal devices to produce a distinct thermal effect that provides an indication of the state of one of a plurality of spinning symbol-bearing reels to facilitate a skill mechanic of the player during a skill-based feature of the wagering game.

26. A gaming chair for a wagering game system configured to conduct a wagering game, the gaming chair comprising:

a seat portion;

a backrest portion;

a base connected to and supporting the seat portion and the backrest portion;

a plurality of discrete thermal devices coupled to the seat portion or the backrest portion, or both, and configured to produce a thermal effect; and at least one controller in operative communication with the thermal devices, the at least one controller being configured to actuate each of the thermal devices to produce a distinct thermal effect that provides at least one of (i) an indication of a volatility for each of a plurality of player selectable options of the wagering game, (ii) an indication of the state of one of a plurality of spinning symbol-bearing reels to facilitate a skill mechanic of the player during a skill-based feature of the wagering game, or (iii) a precursory cue facilitating a skill mechanic of the player during a skill-based feature of the wagering game.

* * * * *

UNITED STATES PATENT AND TRADEMARK OFFICE

CERTIFICATE OF CORRECTION

PATENT NO. : 9,058,714 B2
APPLICATION NO. : 13/477704
DATED : June 16, 2015
INVENTOR(S) : Vernon W. Hamlin et al.

It is certified that error appears in the above-identified patent and that said Letters Patent is hereby corrected as shown below:

In the claims

In Column 40, Line 62 (Claim 2, line 3), delete “the” after “buttons,”

In Column 41, Line 50 (Claim 10, line 1), delete “the” after “wherein”

In Column 44, Line 34 (Claim 28, line 13), insert -- : -- before “(i)”

Signed and Sealed this
Twentieth Day of October, 2015

Michelle K. Lee

Michelle K. Lee
*Director of the United States Patent and Trademark Office*